US011116269B2

(12) United States Patent
Kanazawa et al.

(10) Patent No.: US 11,116,269 B2
(45) Date of Patent: Sep. 14, 2021

(54) ATTACHING APPARATUS AND METHOD FOR ATTACHING ATTACHMENT OBJECT TO FABRIC USING FASTENING MEMBER

(71) Applicant: YKK Corporation, Tokyo (JP)

(72) Inventors: Hiroaki Kanazawa, Tokyo (JP); Ryusaku Watanabe, Tokyo (JP)

(73) Assignee: YKK Corporation, Tokyo (JP)

( * ) Notice: Subject to any disclaimer, the term of this patent is extended or adjusted under 35 U.S.C. 154(b) by 279 days.

(21) Appl. No.: 16/339,717

(22) PCT Filed: Oct. 11, 2016

(86) PCT No.: PCT/JP2016/080148
§ 371 (c)(1),
(2) Date: Apr. 4, 2019

(87) PCT Pub. No.: WO2018/069980
PCT Pub. Date: Apr. 19, 2018

(65) Prior Publication Data

US 2019/0281914 A1 Sep. 19, 2019

(51) Int. Cl.
*A41H 37/04* (2006.01)
*A44B 17/00* (2006.01)

(52) U.S. Cl.
CPC ..... *A41H 37/04* (2013.01); *A44B 17/0011* (2013.01); *A44B 17/0041* (2013.01); *A44B 17/0088* (2013.01)

(58) Field of Classification Search
CPC ..... A41H 37/04; A41H 37/02; A41H 37/001; A44B 17/0011; A44B 17/0041; A44B 17/0088
See application file for complete search history.

(56) References Cited

U.S. PATENT DOCUMENTS 2,373,436 A 4/1945 Treciokas
3,179,319 A 4/1965 Barker et al.
4,454,650 A * 6/1984 Silver ..... A41H 37/04 227/149

FOREIGN PATENT DOCUMENTS

CN 202536182 U 11/2012
EP 1537798 A2 6/2005
JP S57-102517 U 6/1982
(Continued)

OTHER PUBLICATIONS

International Search Report, PCT Patent Application No. PCT/JP2016/080148, dated Dec. 27, 2016.
(Continued)

*Primary Examiner* — Rick K Chang
(74) *Attorney, Agent, or Firm* — Kilpatrick Townsend & Stockton LLP

(57) ABSTRACT

An attaching apparatus, which attaches an attachment object to a fabric using a fastening member, includes at least one pair of first holding members configured to hold an attachment object; and a first die configured to hold the attachment object at a terminal of a die main body. The first die moves such that the attachment object, held at the at least one pair of first holding members, is held at the terminal of the die main body and then the attachment object is placed onto the fabric. The attachment object is transferred from the at least one pair of first holding members to the first die at a position distanced away from the fabric.

12 Claims, 17 Drawing Sheets

(56) References Cited

FOREIGN PATENT DOCUMENTS

| | | | |
|---|---|---|---|
| JP | 2592699 | Y2 | 3/1999 |
| JP | 2005-299043 | A | 10/2005 |
| JP | 3124434 | U | 8/2006 |
| JP | 2007-204874 | A | 8/2007 |
| WO | 2013/118262 | A1 | 8/2013 |
| WO | 2014/061140 | A1 | 4/2014 |

OTHER PUBLICATIONS

Extended European Search Report, European Patent Application No. 16918779.6, dated Jul. 15, 2020, 8 pages.
International Preliminary Report on Patentability, PCT Patent Application No. PCT/JP2016/080148, dated Apr. 25, 2019.
Office Action, Chinese Patent Aplication No. 201680088459.9, dated Apr. 14, 2020.

* cited by examiner

ATTACHING APPARATUS AND METHOD FOR ATTACHING ATTACHMENT OBJECT TO FABRIC USING FASTENING MEMBER

TECHNICAL FIELD

The present disclosure is related to an attaching apparatus and a method for attaching an attachment object to a fabric using a fastening member.

BACKGROUND ART

Patent literature 1 discloses notably at its paras. 0027 and 0029 that a guide punch 19 is used for swaging.

Patent literature 2 discloses notably at its para. 0017 that a button 20 is automatically or manually set to a button-side die 50.

CITATION LIST

Patent Literature

[PTL 1] Japanese Registered Utility-model No. 2592699
[PTL 2] International Publication No. 2014/061140

SUMMARY

Technical Problem

In a case where an attachment object 20 is attached adjacently to a portion where fabrics 30 are laminated as shown in FIG. 20, a holding member i.e. an arm member 50 for holding an attachment object 20 may be interfered with the fabric 30, causing that the attachment object 20 cannot maintain its correct posture and the attachment object 20 cannot be attached to the fabric 30 appropriately. The present inventors have newly identified a value of relaxing a constraint regarding attachment position of an attachment object onto a fabric.

Solution to Problem

An attaching apparatus according to an aspect of the present disclosure may be an attaching apparatus that attaches an attachment object to a fabric using a fastening member, the apparatus including:

at least one pair of first holding members configured to hold an attachment object; and a first die configured to hold the attachment object at a terminal of a die main body, wherein the first die moves such that the attachment object, held by the at least one pair of first holding members, is held at the terminal of the die main body and then the attachment object is placed onto the fabric, and the attachment object is transferred from the at least one pair of first holding members to the first die at a position distanced away from the fabric.

In some exemplary embodiments, the first die includes one or more pressing members for holding the attachment object at the terminal of the die main body, the pressing member being elastically displaceable.

In some exemplary embodiments, the first die comprises a plurality of pressing members for holding the attachment object at the terminal of the die main body, the plurality of pressing members being coupled via an elastic member.

In some exemplary embodiments, the plurality of pressing members are arranged around the die main body and are displaceable in an axial direction of the die main body.

In some exemplary embodiments, a bottom portion and/or a bottom surface of the terminal of the die main body is configured to hold the attachment object detachably.

In some exemplary embodiments, movement of the first die toward the fabric causes movement of the respective first holding members, allowing the attachment object to be released from the at least one pair of first holding members.

In some exemplary embodiments, the release of the attachment object from the at least one pair of first holding members initiates synchronously with that the attachment object is held at the terminal of the die main body.

In some exemplary embodiments, the die main body includes an increased-diameter portion having a diameter that gradually increases as being away from the terminal, and the increased-diameter portion of the die main body moves the respective first holding members radially outwardly.

In some exemplary embodiments, the first holding member includes a pivotable arm member, and the arm member includes a pivotal axis and a supporting end for holding the attachment object.

In some exemplary embodiments, the first holding member includes a pivotable arm member, and the arm member includes a pivotal axis and a supporting end for holding the attachment object, and the arm member has a pushed surface between the pivotal axis and the supporting end, the pushed surface being pushed radially outwardly by the increased-diameter portion of the die main body.

In some exemplary embodiments, the attaching apparatus further includes a base portion to which the arm member is axially coupled, the base portion being a stationary portion that is not displaced in the attaching apparatus.

In some exemplary embodiments, the fastening member includes an annular base and a plurality of legs arranged along the annular base. The apparatus further includes a second die that includes:

a pin that is inserted into the annular base; and a pusher that is arranged around the pin and pushes the fastening member toward the attachment object held by the terminal.

In some exemplary embodiments, the second die further includes at least one pair of second holding members that holds the fastening member, and movement of the pusher toward the fabric causes movement of the respective second holding members, allowing the fastening member to be released from the at least one pair of second holding members.

In some exemplary embodiments, the attaching apparatus further includes a slider that transfers the attachment object to the pair of first holding members, and the slider is coupled via a linkage to a driving source that is common with the first die.

A method of attaching according to an aspect of the present disclosure may be a method of attaching an attachment object to a fabric using a fastening member, supplying an attachment object to at least one pair of first holding members;

moving a first die toward the attachment object, held by the at least one pair of first holding members, so that the attachment object is held at a terminal of a die main body of the first die;

releasing the attachment object from the at least one pair of first holding members synchronously with the attachment object being held at the terminal; and moving the first die, in which the attachment object is held at the terminal, to carry the attachment object until the attachment object is in contact with the fabric.

A method of producing a fabric product according to an aspect of the present disclosure may be a method of producing a fabric product to which an attachment object is attached using a fastening member, the method including:

supplying an attachment object to at least one pair of first holding members;

moving a first die toward the attachment object, held by the at least one pair of first holding members, so that the attachment object is held at a terminal of a die main body of the first die;

releasing the attachment object from the at least one pair of first holding members synchronously with the attachment object being held at the terminal; and moving the first die, in which the attachment object is held at the terminal, to carry the attachment object until the attachment object is in contact with the fabric.

Advantageous Effects of Invention

According to an aspect of the present disclosure, it may be possible to relax a constraint regarding attachment position of attachment object on a fabric.

DESCRIPTION OF EMBODIMENTS

Hereinafter, non-limiting exemplary embodiments of the present invention will be described with reference to FIGS.

1 to 19. Disclosed one or more embodiments and respective features included in the embodiments are not mutually exclusive. A skilled person would be able to combine respective embodiments and/or respective features without requiring excess descriptions. A skilled person would appreciate synergistic effects of such combinations. Overlapping descriptions among the embodiments would be basically omitted. Referenced drawings are prepared for the purpose of illustration of invention, and may possibly be simplified for the sake of convenience of illustration.

Figure 1:
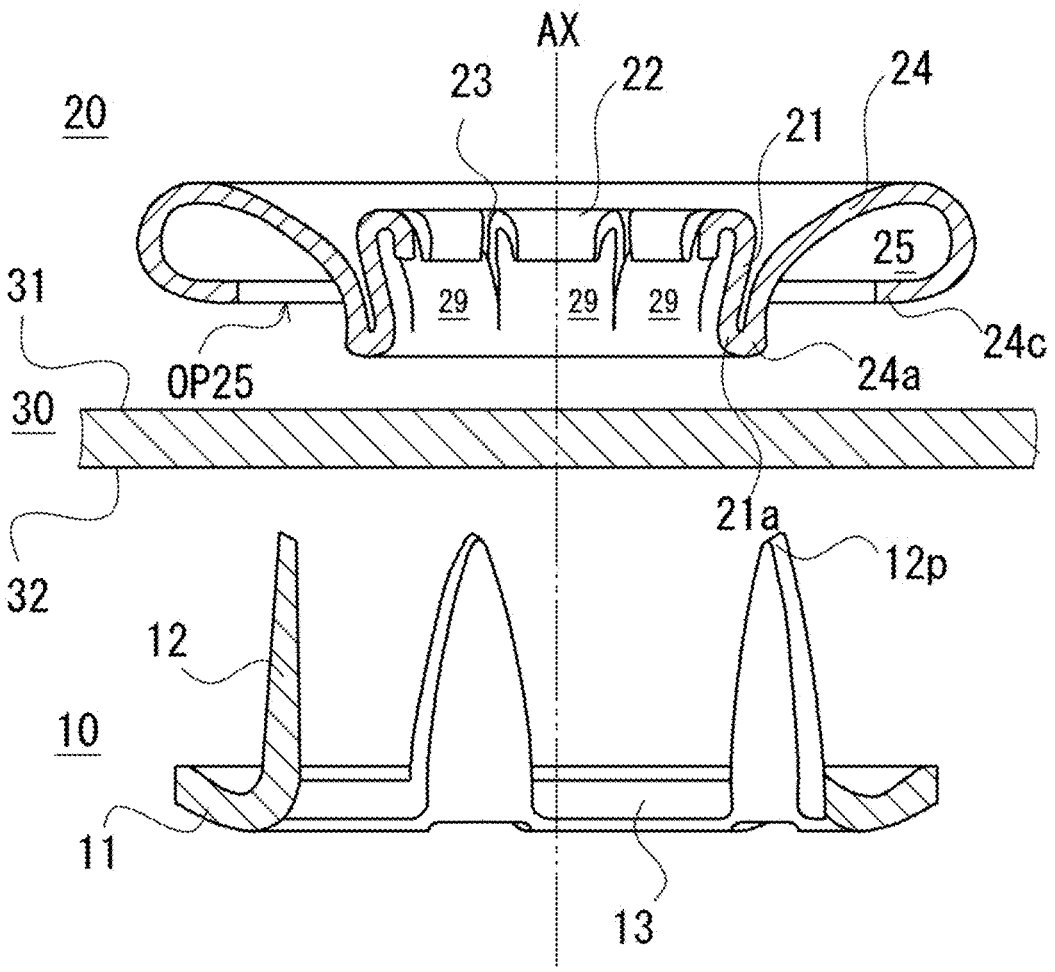
FIG. 1 is a schematic cross-sectional view showing an attachment object and a fastening member before they are attached to a fabric.
Figure 2:
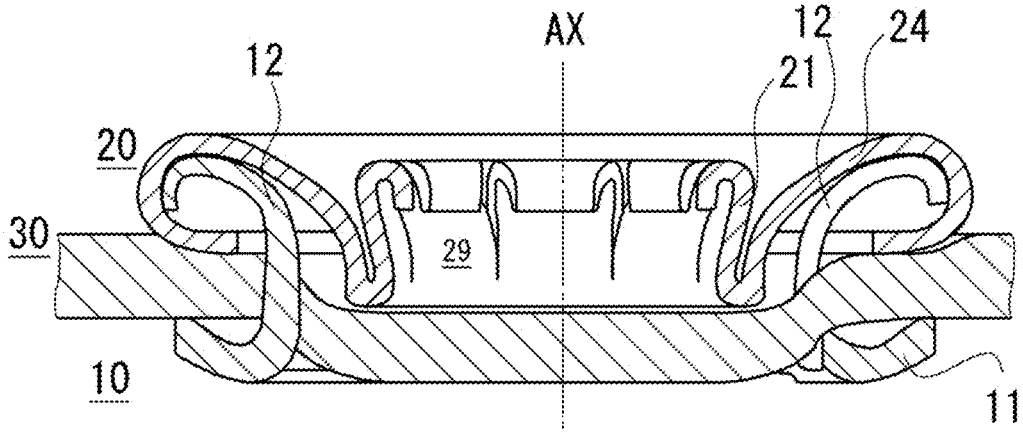
FIG. 2 is a schematic cross-sectional view showing an attachment object and a fastening member after they are attached to a fabric.
Figure 3:
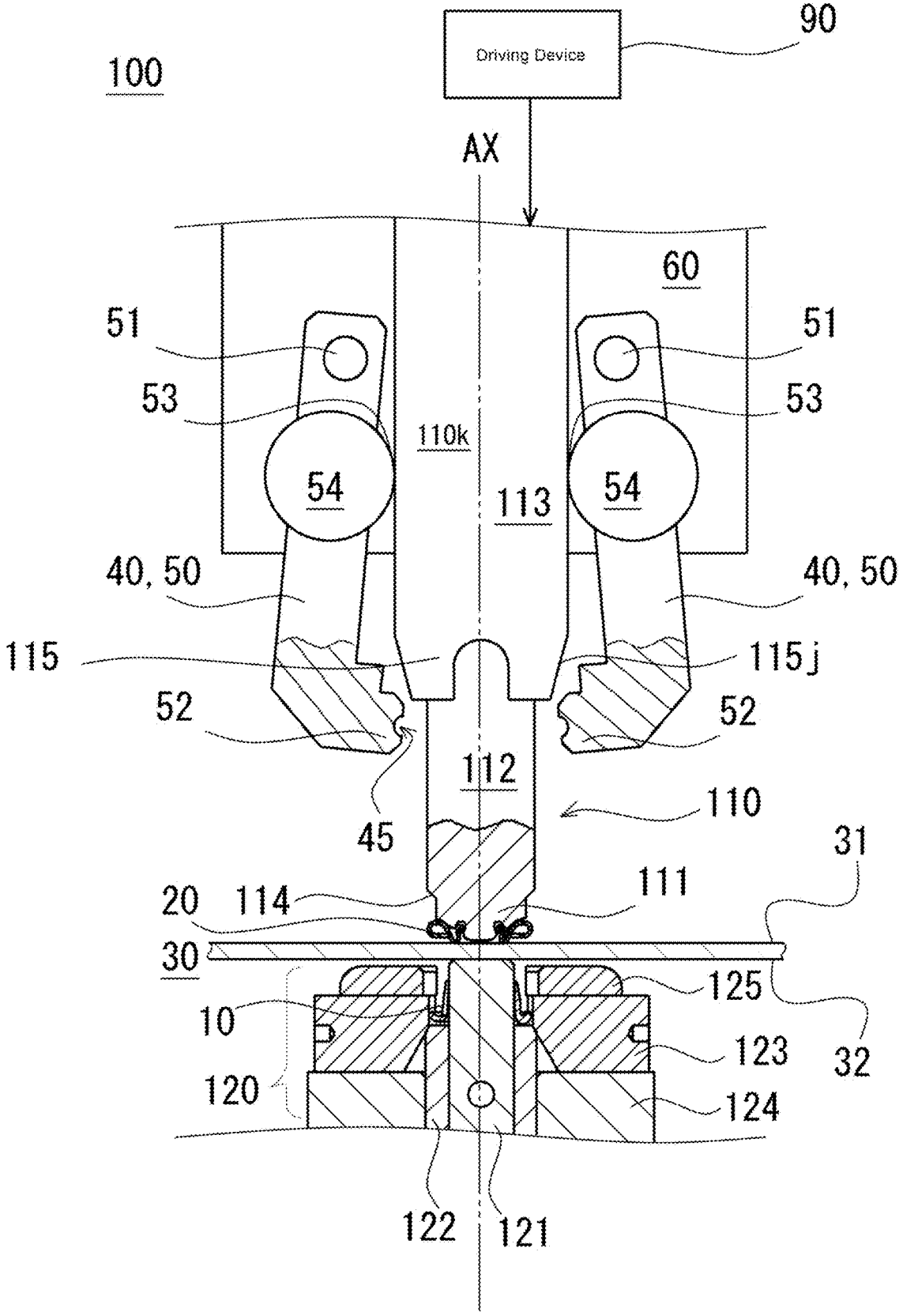
FIG. 3 is a schematic partial view of an attaching apparatus according to a non-limiting exemplary embodiment of the present disclosure. A first die and first holding members are partially illustrated in cross-sectional views and a second die is illustrated in a cross-sectional view. An attachment object is held at a terminal of a die main body of a first die and is placed onto a top surface of a fabric.
Figure 4:
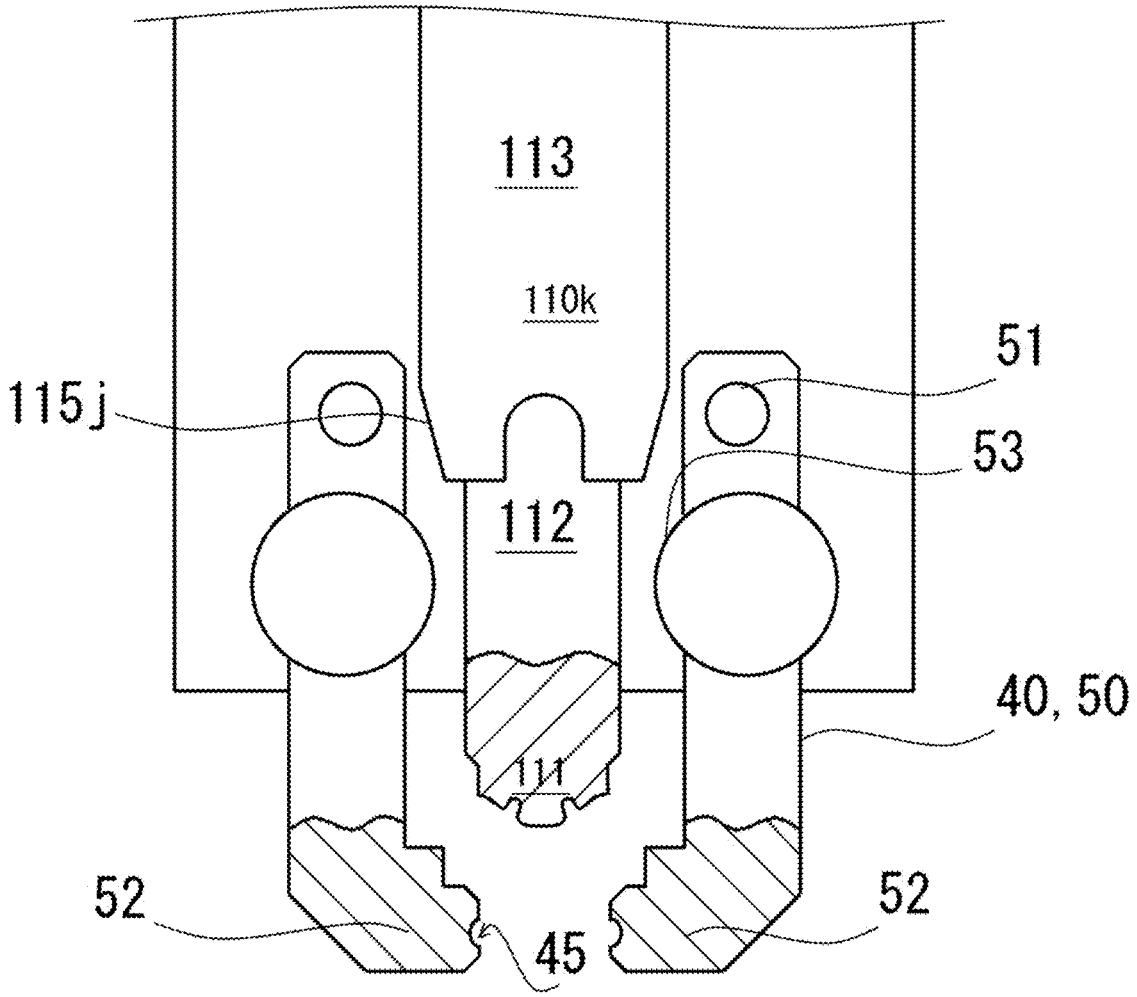
FIG. 4 is a schematic partial view of an attaching apparatus according to a non-limiting exemplary embodiment of the present disclosure, illustrating a condition before an attachment object is supplied to a pair of first holding members.
Figure 5:
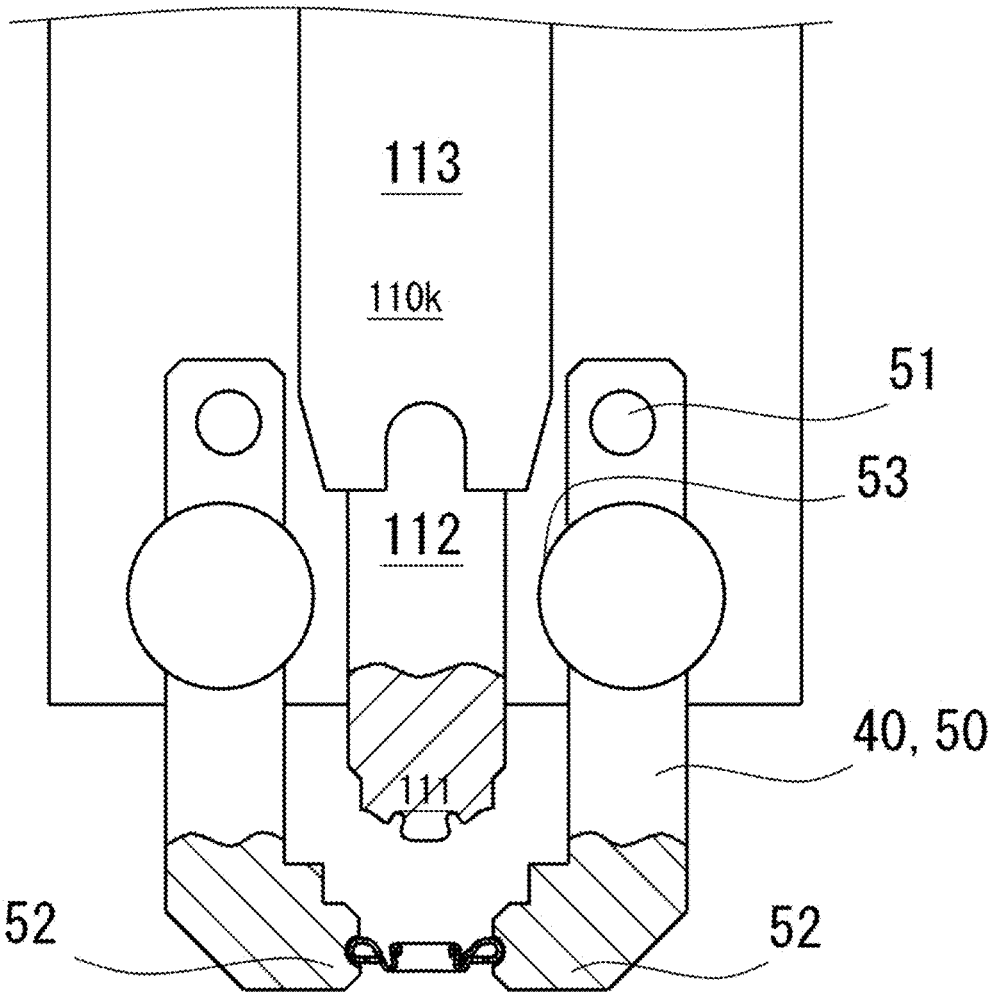
FIG. 5 is a schematic partial view of an attaching apparatus according to a non-limiting exemplary embodiment of the present disclosure, illustrating a condition where an attachment object has been supplied to a pair of first holding members, and an attachment object has been held by the pair of first holding members.
Figure 6:
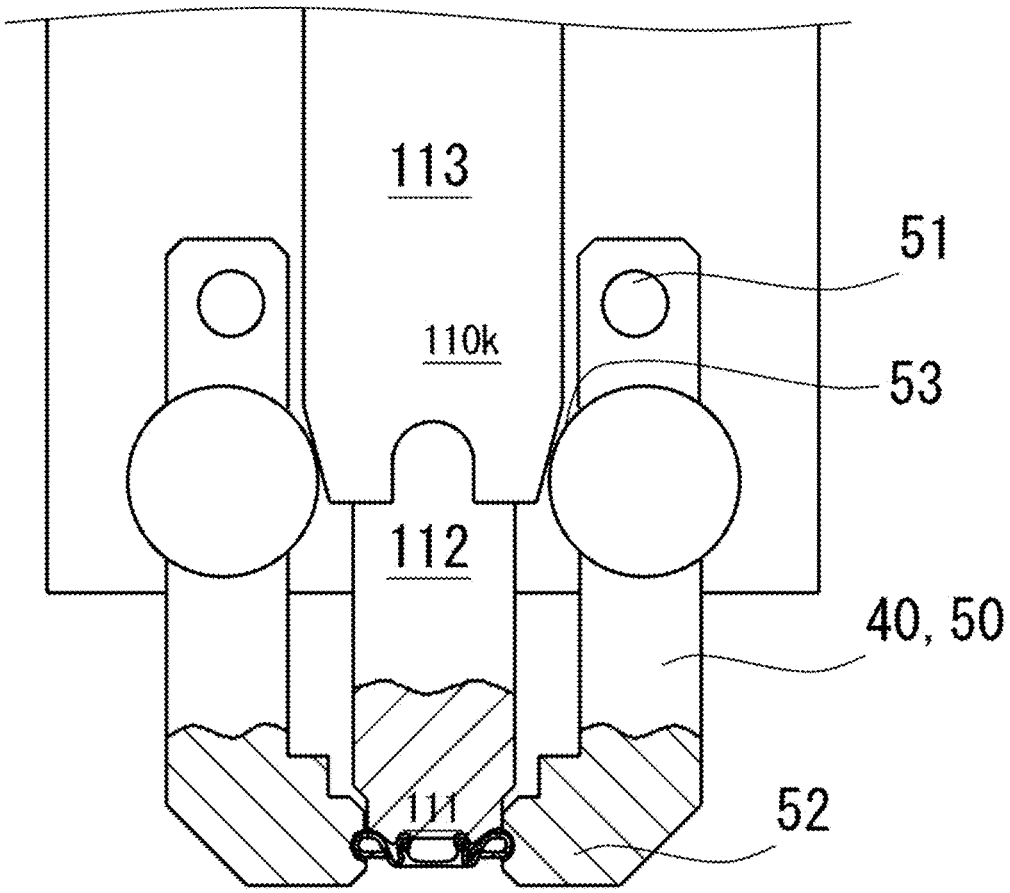
FIG. 6 is a schematic partial view of an attaching apparatus according to a non-limiting exemplary embodiment of the present disclosure, illustrating a condition where an attachment object being held by a pair of first holding members is held at a terminal of a die main body of a first die.
Figure 7:
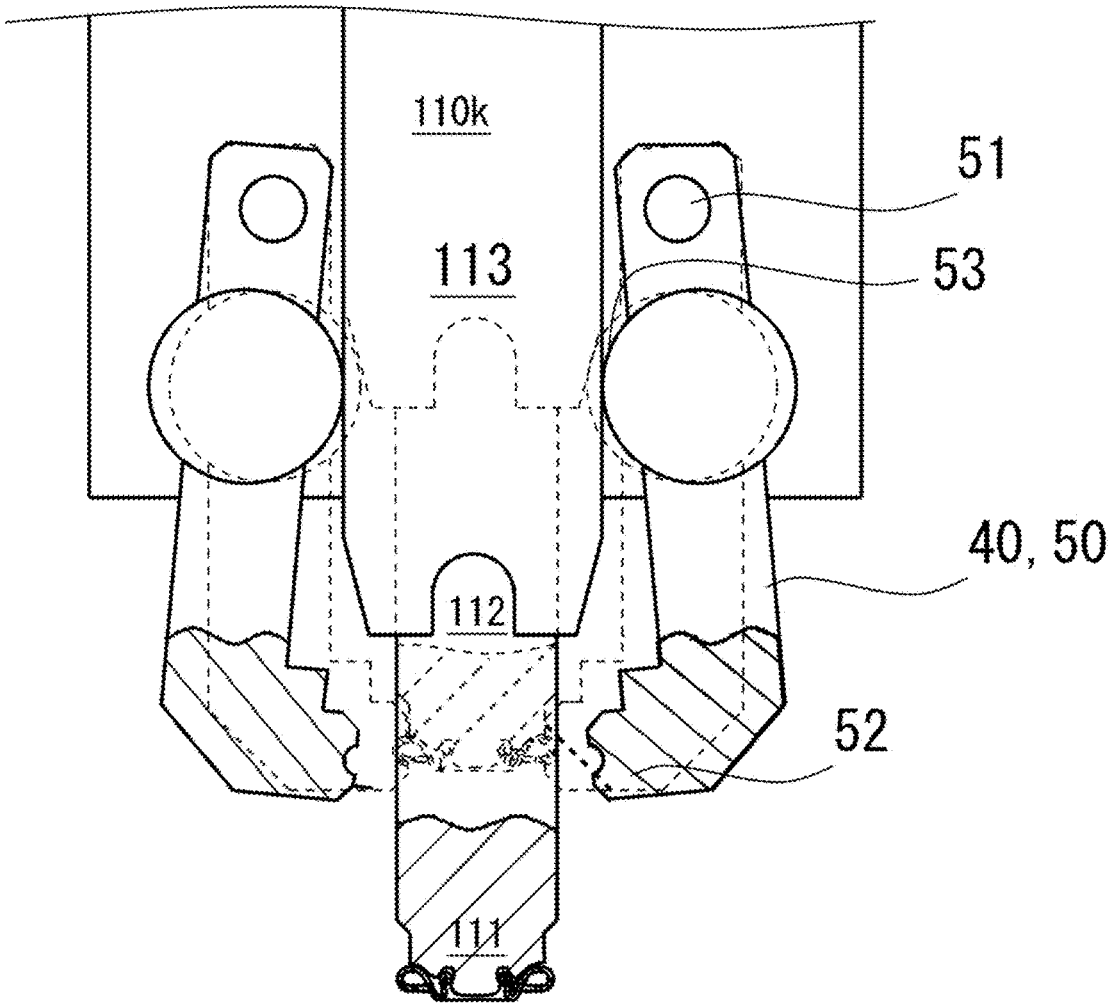
FIG. 7 is a schematic partial view of an attaching apparatus according to a non-limiting exemplary embodiment of the present disclosure, illustrating that an attachment object, held at a terminal of a die main body of a first die, also descends as the first die descends; and paired first holding members pivot radially outwardly as the first die descends so that an attachment object is released from the paired first holding members. A dotted line in FIG. 7 schematically illustrates a first die and first holding members shown in FIG. 6.
Figure 8:
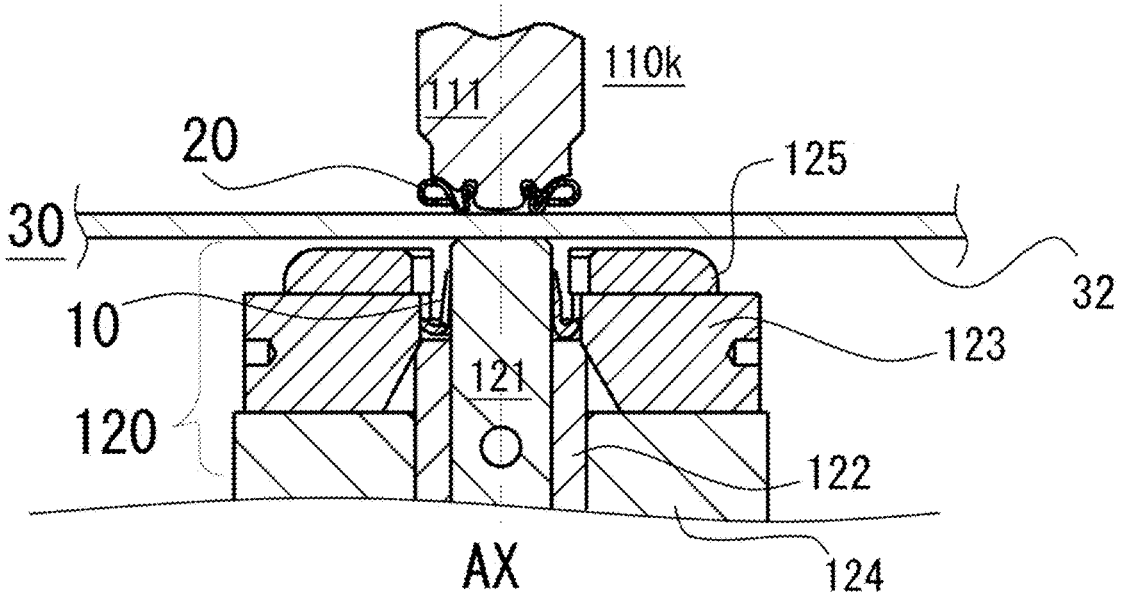
FIG. 8 is a schematic partial view of an attaching apparatus according to a non-limiting exemplary embodiment of the present disclosure, illustrating a condition where a pin of a second die has been inserted into an annular base of a fastening member, and the annular base of the fastening member is placed onto a top end of a pusher of the second die, and the annular base of the fastening member is held by a pair of second holding members of the second die.
Figure 9:
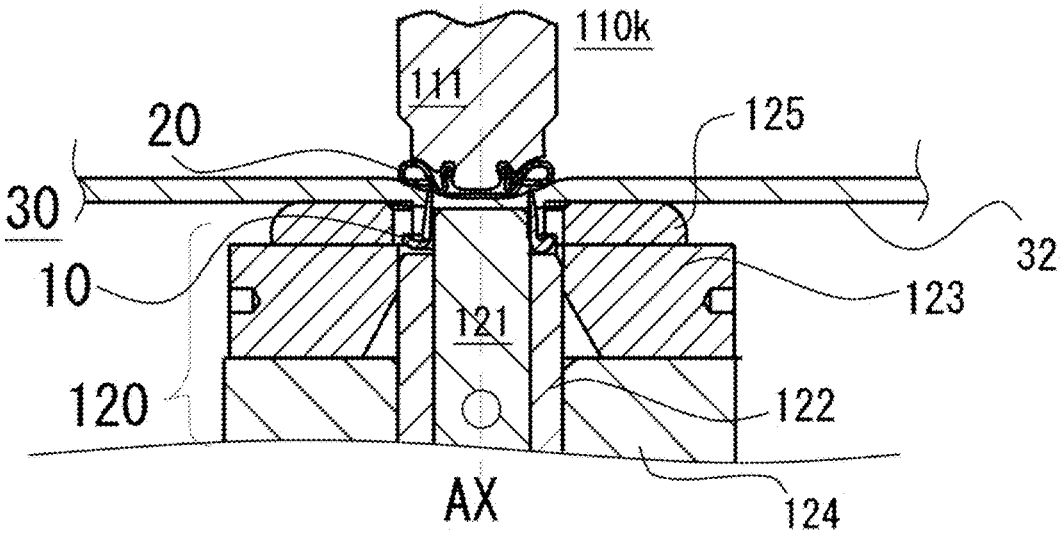
FIG. 9 is a schematic partial view of an attaching apparatus according to a non-limiting exemplary embodiment of the present disclosure, illustrating that a fastening member released from a pair of second holding members is moved upward.
Figure 10:
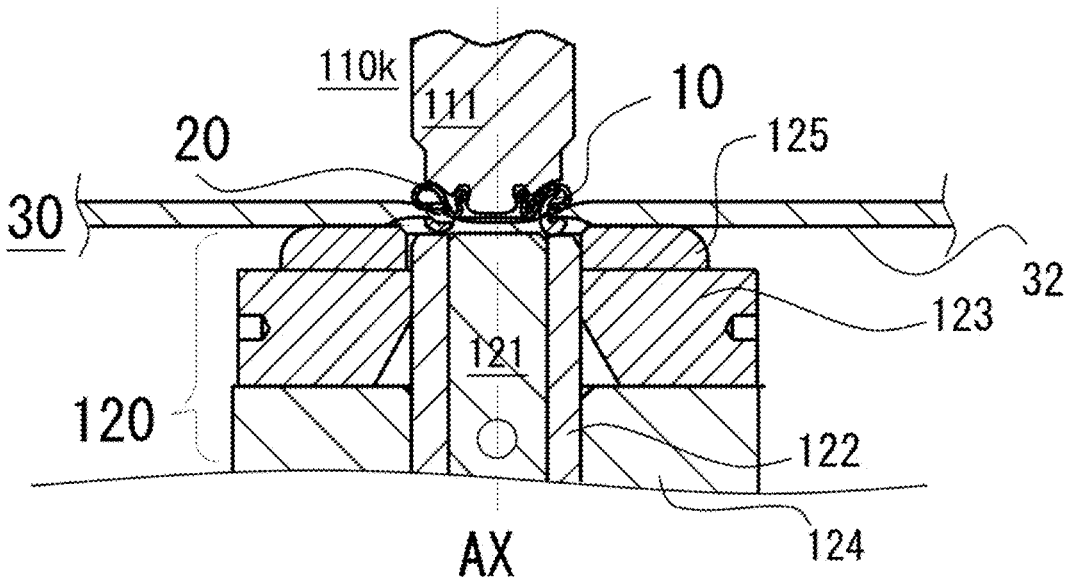
FIG. 10 is a schematic partial view of an attaching apparatus according to a non-limiting exemplary embodiment of the present disclosure, illustrating a condition where legs of a fastening member placed on a pusher penetrate through a fabric, and are inserted into and bent in a hollow of a flange of an attachment object placed on a top surface of the fabric.
Figure 11:
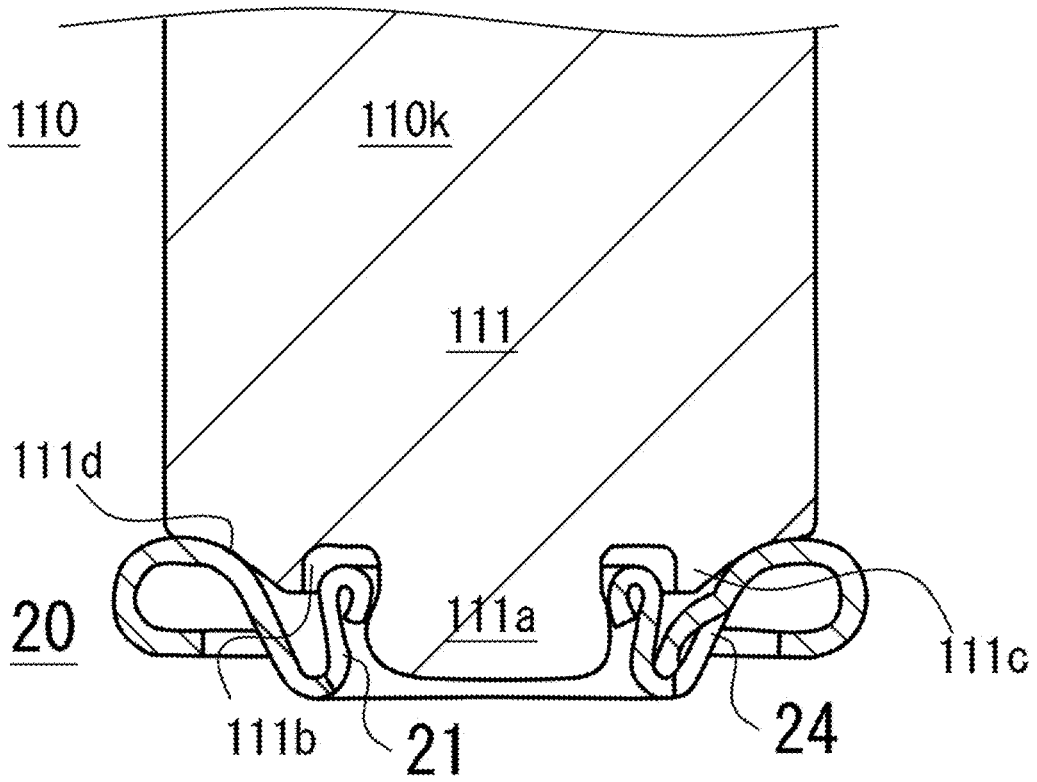
FIG. 11 shows a detailed structure of a terminal of a die main body of a first die of an attaching apparatus according to a non-limiting exemplary embodiment of the present disclosure.
Figure 12:
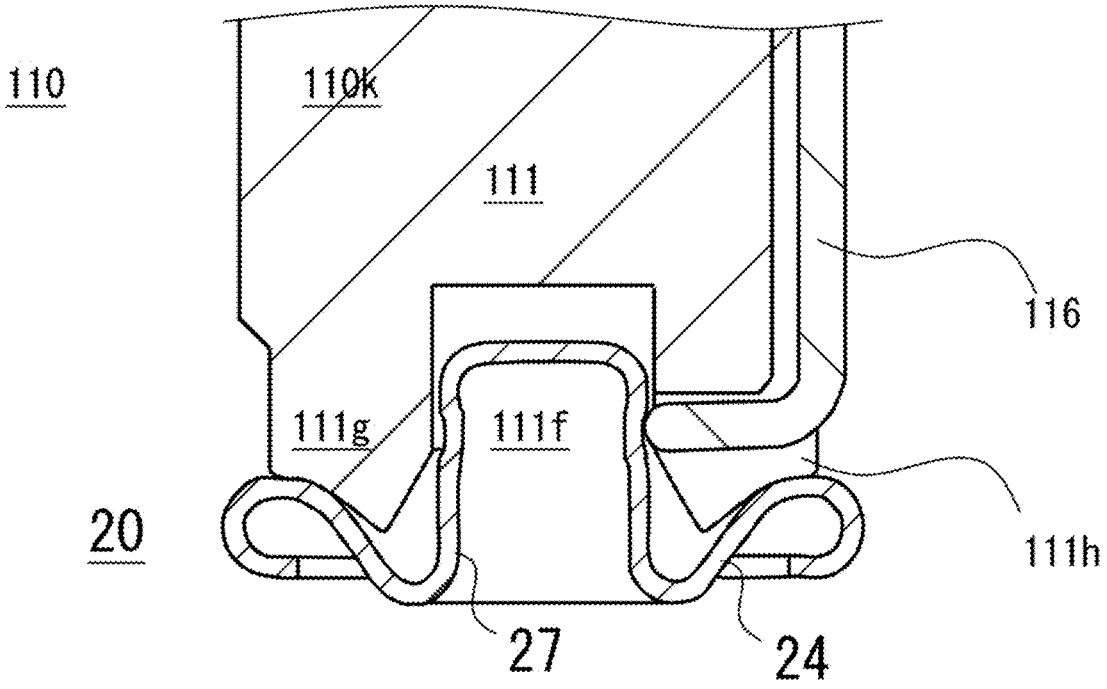
FIG. 12 shows another exemplary structure of a terminal of a die main body of a first die of an attaching apparatus according to a non-limiting exemplary embodiment of the present disclosure.
Figure 13:
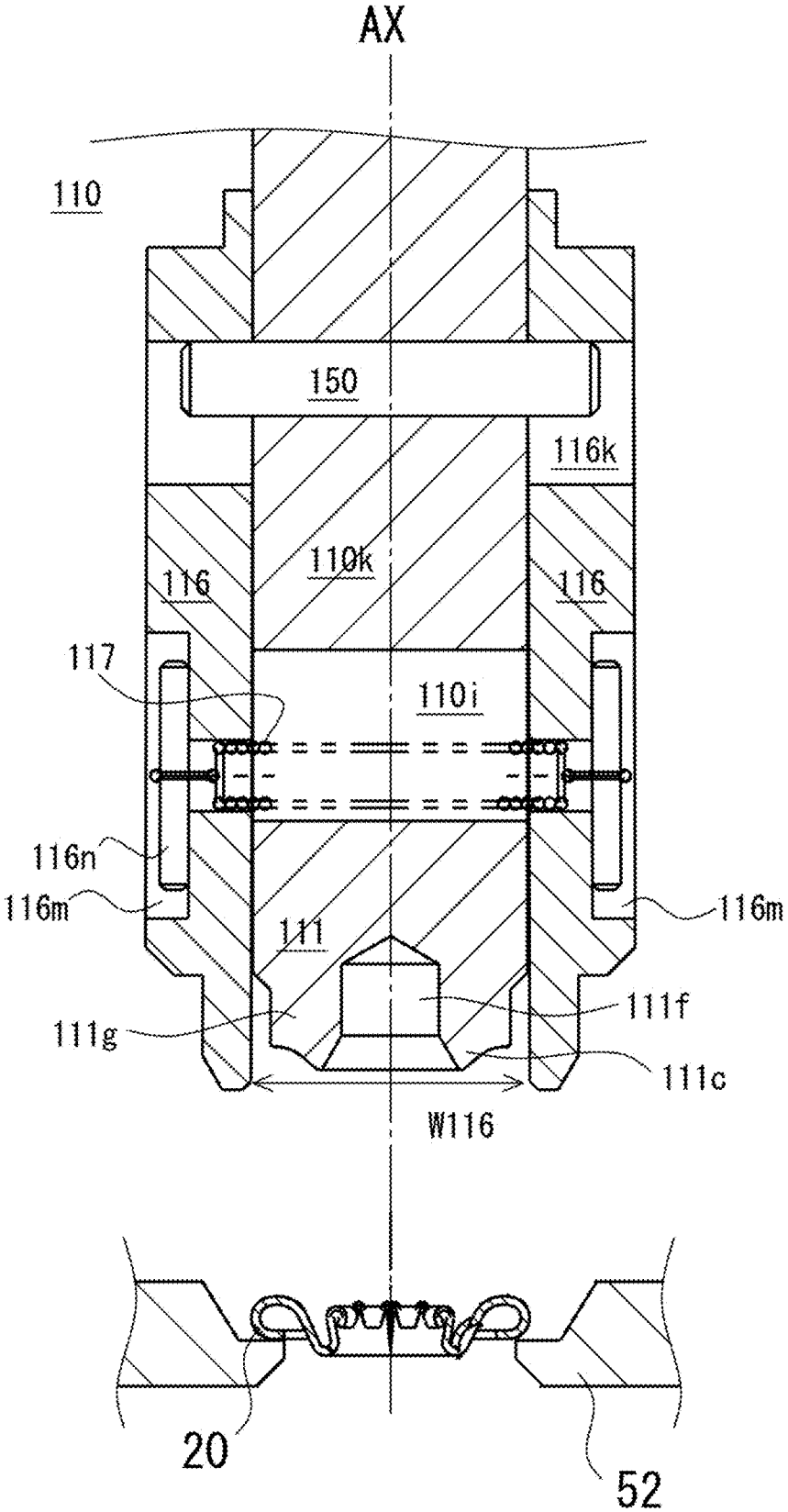
FIG. 13 is a schematic cross-sectional view of another type of a first die of an attaching apparatus according to a non-limiting exemplary embodiment of the present disclosure, illustrating a condition before an attachment object is held at a terminal of a die main body of a first die.
Figure 14:
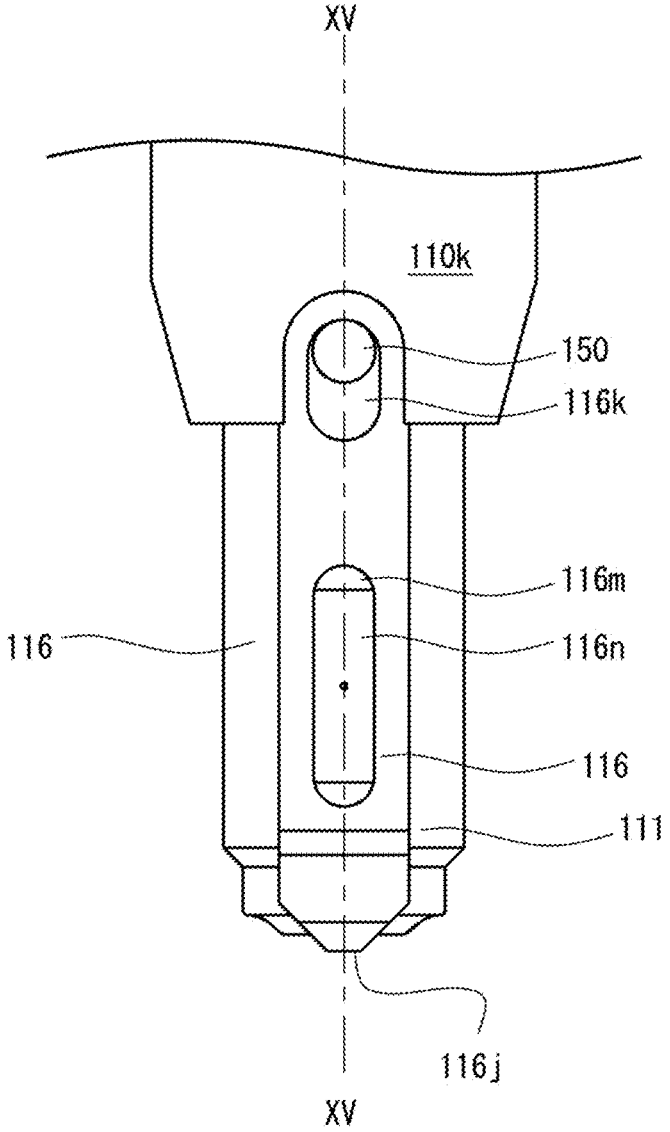
FIG. 14 is a schematic view showing a condition before an attachment object is held at a terminal of a die main body 110*k* of a first die shown in FIG. 13. The attachment object and holding members are shown in cross-section.
Figure 14:
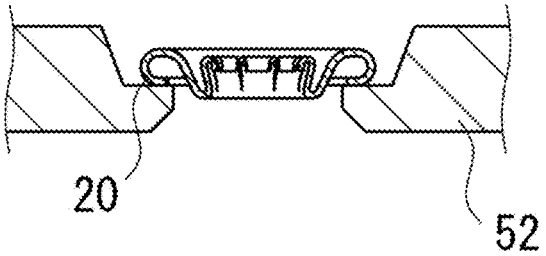
Figure 15:
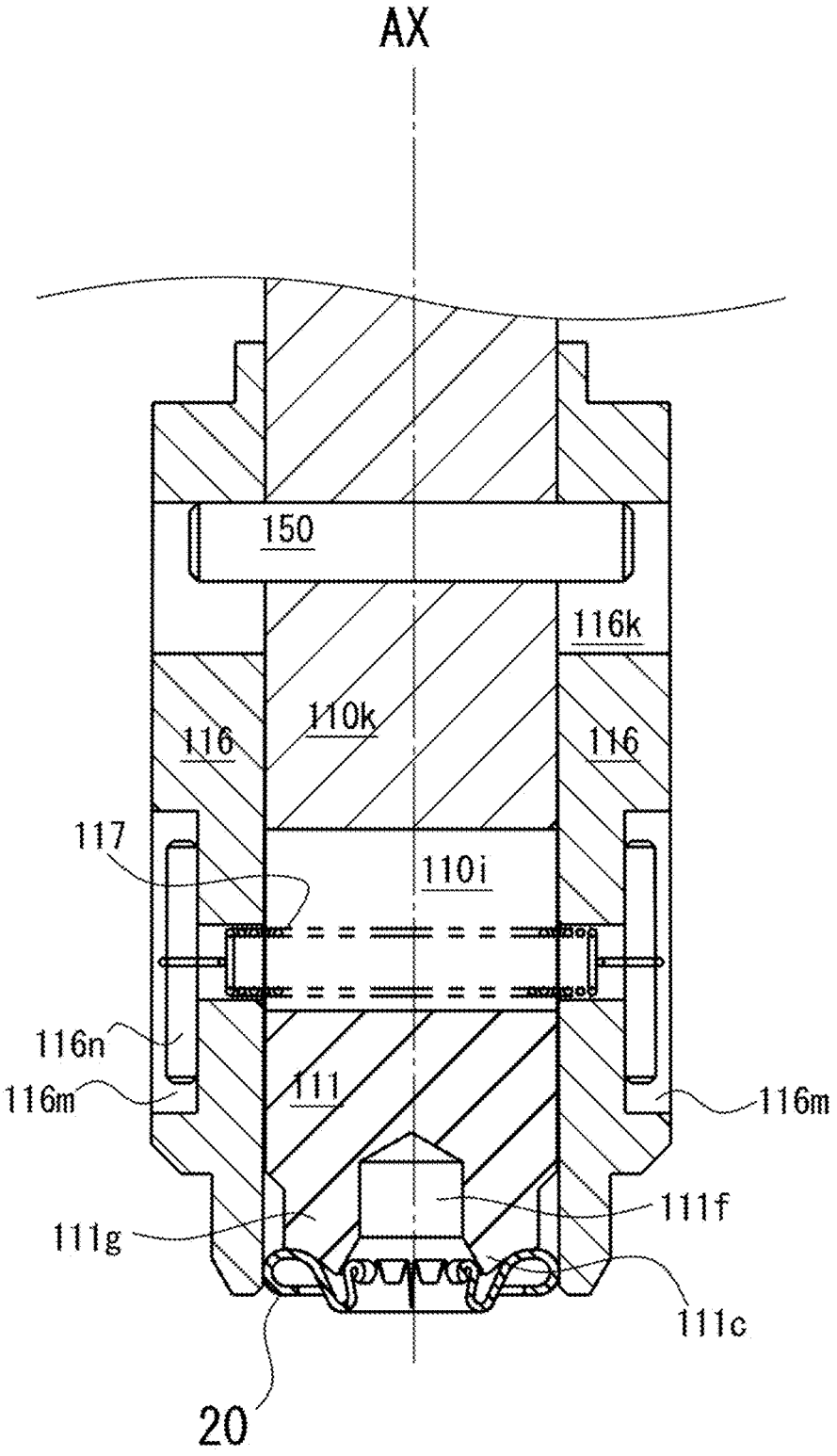
FIG. 15 is a schematic cross-sectional view showing a condition where an attachment object is held at a terminal of a die main body 110*k* of a first die shown in FIG. 13.
Figure 16:
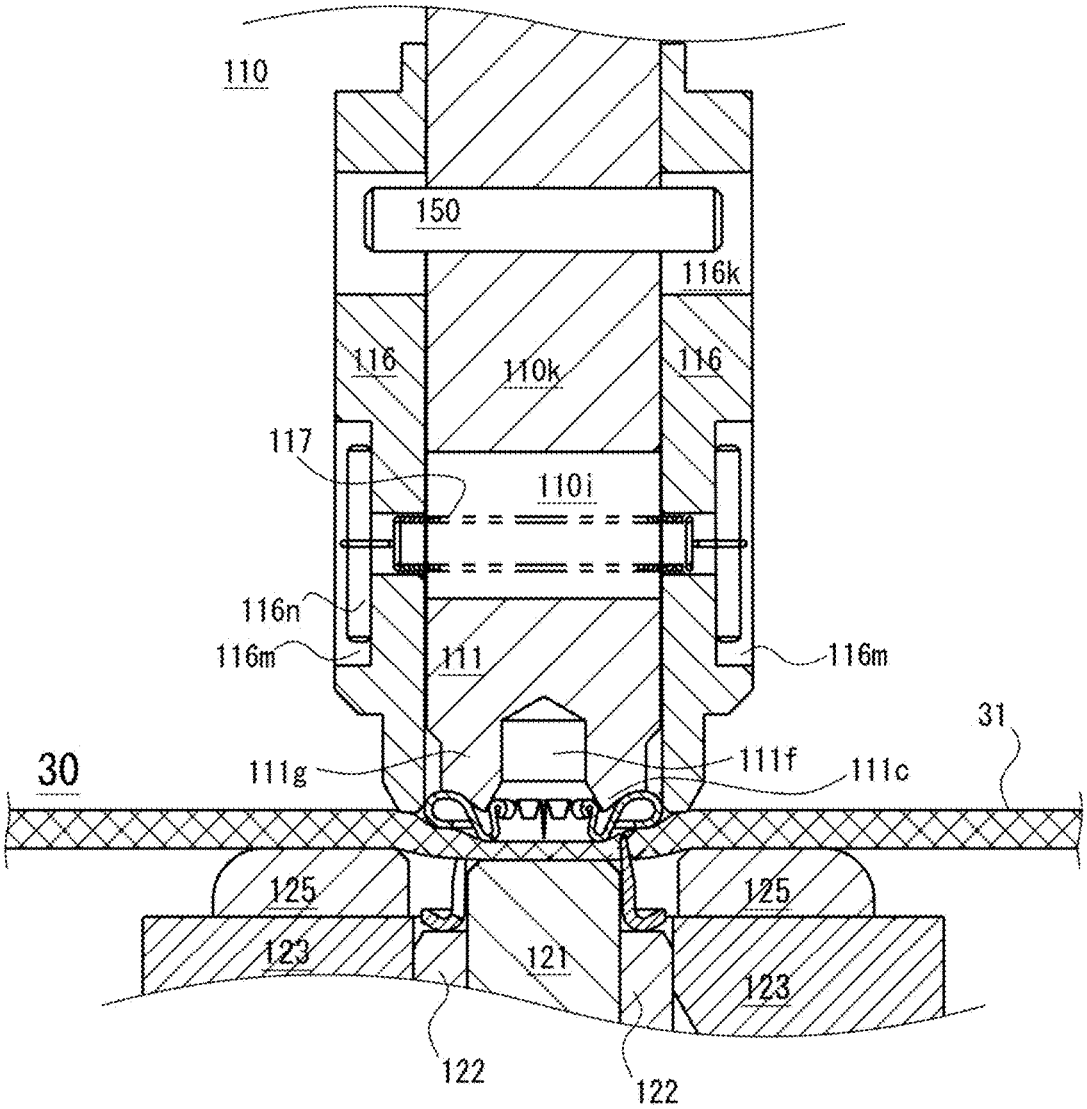
FIG. 16 is a schematic cross-sectional view showing a condition where a pressing member of a first die shown in FIG. 13 touches a fabric.
Figure 17:
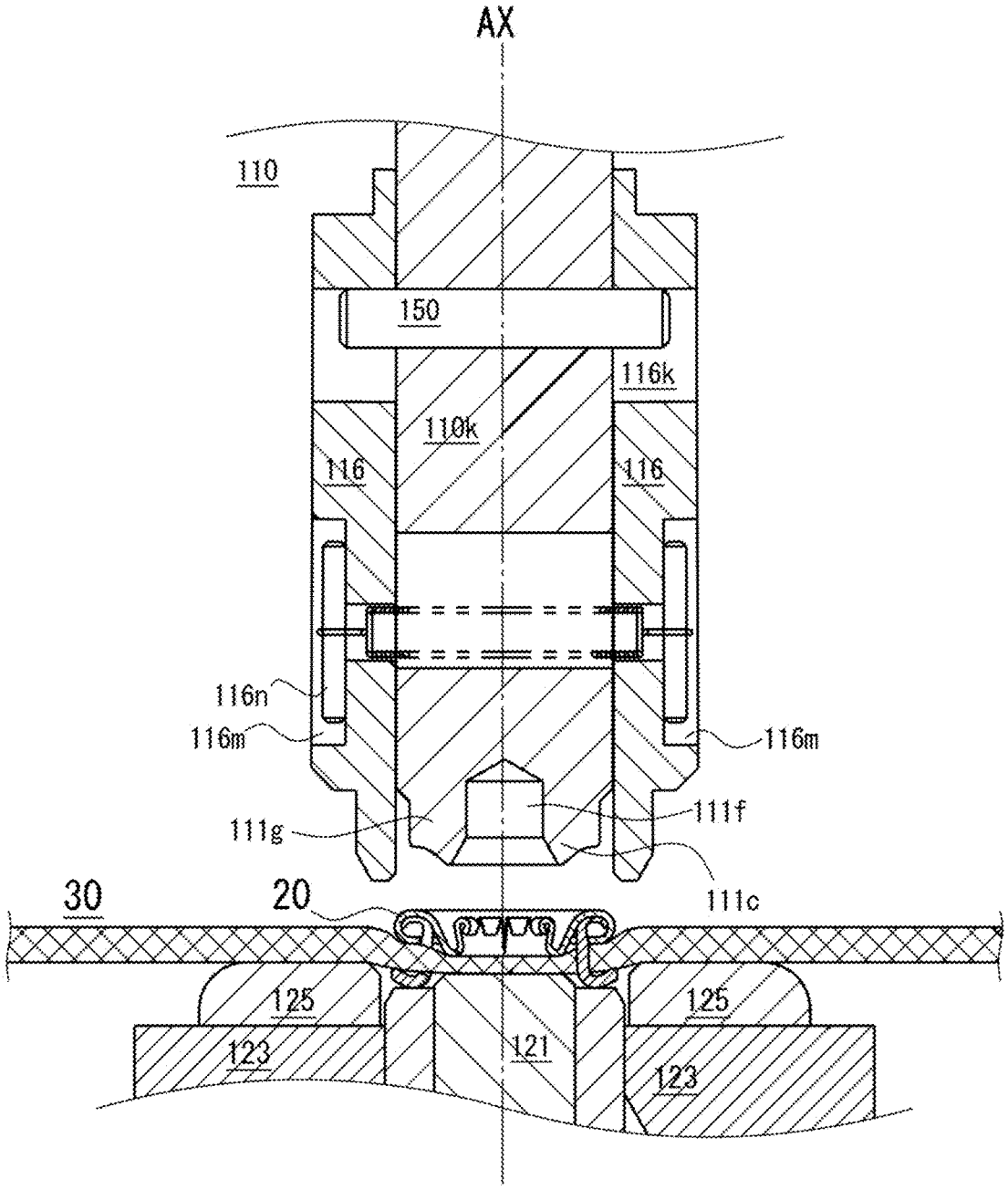
FIG. 17 is a schematic cross-sectional view showing a condition where an attachment object has been released from a first die shown in FIG. 13 onto a fabric and the attachment object has been attached to the fabric.
Figure 18:
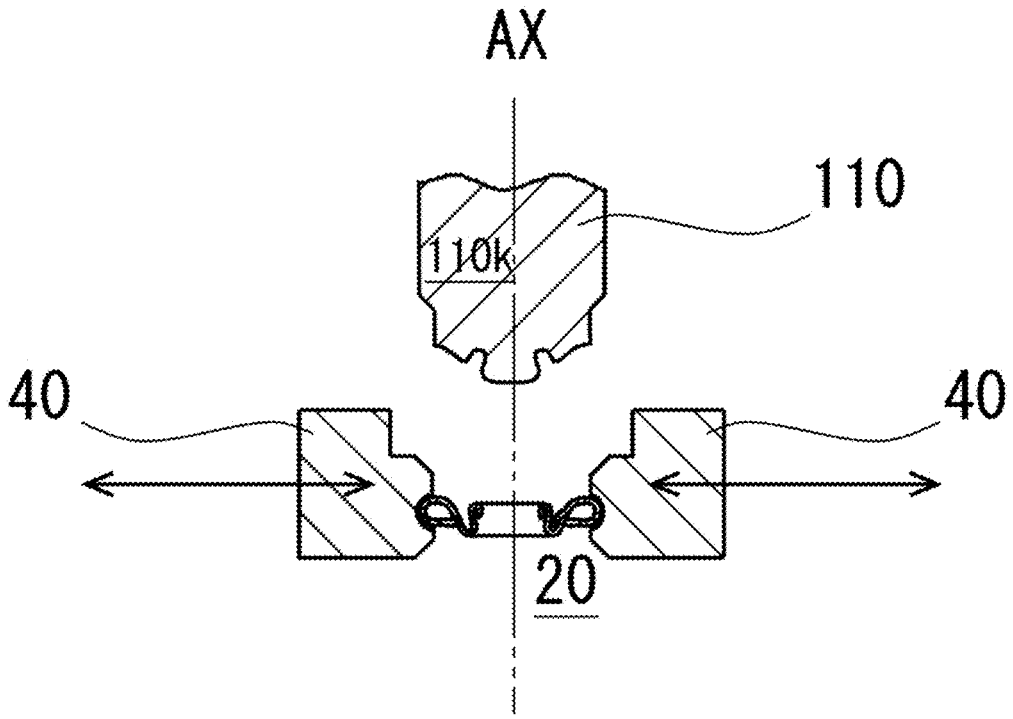
FIG. 18 is a schematic view of an attaching apparatus according to an exemplary variation of a non-limiting exemplary embodiment of the present disclosure, where paired holding members are configured to perform a reciprocating motion in a direction perpendicular to an axial direction.
Figure 19:
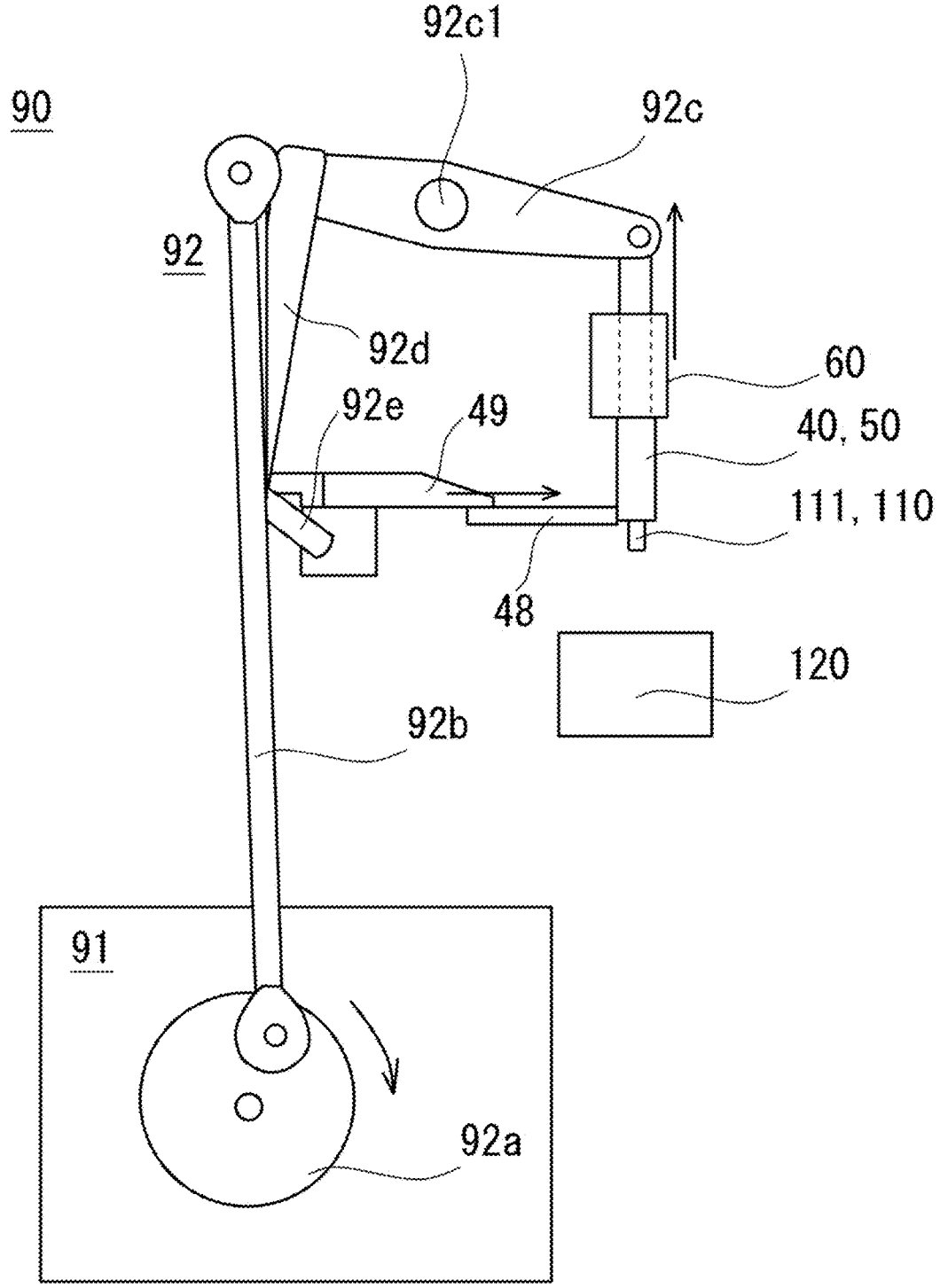
FIG. 19 shows an example of driving device usable in various non-limiting exemplary embodiments of the present disclosure.
Figure 20:
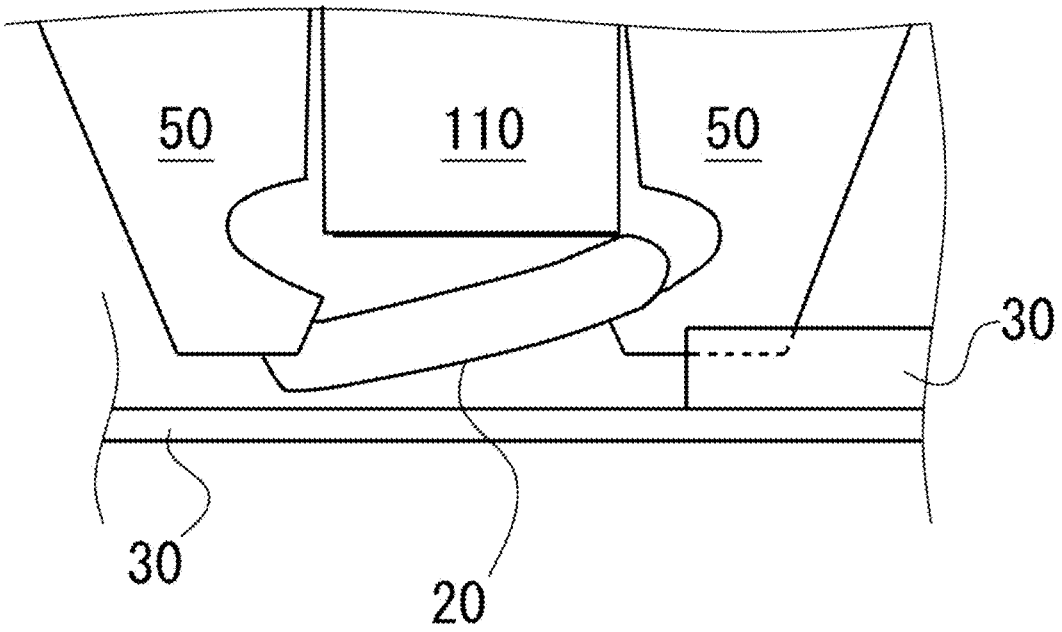
FIG. 20 is a schematic view to be referred for describing a technical problem associated with a non-limiting exemplary embodiment of the present disclosure, showing an example in which, when an attachment object is placed adjacent to a step (level/height difference) of a fabric, an arm is interfered with a fabric and the attachment object cannot take a correct posture.

FIG. 1 is a schematic cross-sectional view showing an attachment object and a fastening member before they are attached to a fabric. FIG. 2 is a schematic cross-sectional view showing an attachment object and a fastening member after they are attached to a fabric. FIG. 3 is a schematic partial view of an attaching apparatus. A first die and first holding members are partially illustrated in cross-sectional views and a second die is illustrated in a cross-sectional view. An attachment object is held at a terminal of a die main body of a first die and is placed onto a top surface of a fabric. FIG. 4 is a schematic partial view of an attaching apparatus, illustrating a condition before an attachment object is supplied to a pair of first holding members. FIG. 5 is a schematic partial view of an attaching apparatus, illustrating a condition where an attachment object has been supplied to a pair of first holding members, and an attachment object has been held by the pair of first holding members. FIG. 6 is a schematic partial view of an attaching apparatus, illustrating a condition where an attachment object being held by a pair of first holding members is held at a terminal of a die main body of a first die. FIG. 7 is a schematic partial view of an attaching apparatus, illustrating that an attachment object, held at a terminal of a die main body of a first die, also descends as the first die descends; and paired first holding members pivot radially outwardly as the first die descends so that an attachment object is released from the paired first holding members. A dotted line in FIG. 7 schematically illustrates a first die and first holding members shown in FIG. 6. FIG. 8 is a schematic partial view of an attaching apparatus, illustrating a condition where a pin of a second die has been inserted into an annular base of a fastening member, and the annular base of the fastening member is placed onto a top end of a pusher of the second die, and the annular base of the fastening member is held by a pair of second holding members of the second die. FIG. 9 is a schematic partial view of an attaching apparatus, illustrating that a fastening member released from a pair of second holding members is moved upward. FIG. 10 is a schematic partial view of an attaching apparatus, illustrating a condition where legs of a fastening member placed on a pusher penetrate through a fabric, and are inserted into and bent in a hollow of a flange of an attachment object placed on a top surface of the fabric. FIG. 11 shows a detailed structure of a terminal of a die main body of a first die of an attaching apparatus. FIG. 12 shows another exemplary structure of a terminal of a die main body of a first die of an attaching apparatus. FIG. 13 is a schematic cross-sectional view of another type of a first die of an attaching apparatus, illustrating a condition before an attachment object is held at a terminal of a die main body of a first die. FIG. 14 is a schematic view showing a condition before an attachment object is held at a terminal of a die main body 110*k* of a first die shown in FIG. 13. The attachment object and holding members are shown in cross-section. FIG. 15 is a schematic cross-sectional view showing a condition where an attachment object is held at a terminal of a die main body 110*k* of a first die shown in FIG. 13. FIG. 16 is a schematic cross-sectional view showing a condition where a pressing member of a first die shown in FIG. 13 touches a fabric. FIG. 17 is a schematic cross-sectional view showing a condition where an attachment object has been released from a first die shown in FIG. 13 onto a fabric and the attachment object has been attached to the fabric. FIG. 18 is a schematic view of an attaching apparatus according to an exemplary variation, where paired holding members are configured to perform a reciprocating motion in a direction perpendicular to an axial direction. FIG. 19 shows an example of driving device usable in various non-limiting exemplary embodiments of the present disclosure. FIG. 20 is a schematic view to be referred for describing a technical problem associated with a non-limiting exemplary embodiment of the present disclosure, showing an example in which, when an attachment object is placed adjacent to a step (level/height difference) of a fabric, an arm is interfered with a fabric and the attachment object cannot take a correct posture.

With reference to FIGS. 1 and 2, descriptions will be made for a fastening member 10 and an attachment object 20 to be handled by an attaching apparatus 100 described below. The attaching apparatus 100 described below may attach the attachment object 20 to a fabric 30 using the fastening member 10. Female-type snap will be referenced and described, but this is just an example. FIG. 12 will be referenced for describing a case where the attaching apparatus 100 described below attaches a male-type snap to a fabric using a fastening member 10. In the present specification, male-type and/or female type snaps will be referenced as an attachment object, but the attachment object could possibly be other types of members other than the snaps such as an eyelet part. The attachment object could be replaced with a snap main body. The snap main body could be a male-type or a female-type.

As shown in FIG. 1, the attachment object 20 is arranged at an upper side of a top surface 31 of the fabric 30, typically placed onto the top surface 31, touching the top surface 31. The fastening member 10 is arranged at a lower side of a bottom surface 32 of the fabric 30. The fabric 30 should not be limited to any textile or knitted fabric. In some cases, the fabric 30 consists of a base textile and a coating layer covering the base textile.

The attachment object 20 is a female-type snap. The attachment object 20 is a ring-like thin part when viewed from an upper side. The attachment object 20 has a central tube 21 and a flange 24 provided around the central tube 21. The central tube 21 extends along an axial line AX that indicates an axial movement trajectory of a part or an entirety of first and/or second die described below. The central tube 21 is configured such that an engagement protrusion of a non-illustrated male-type snap is snap-coupled thereto. In the illustrated example, the central tube 21 includes a plurality of walls 29 separated by slits 23. These plurality of walls 29 are arranged in a circle in a circumferential direction centered around the axial line AX. Top end portion of each wall 29 is provided with a round edge 22 rounded radially inwardly.

A head having a wider width of an engagement protrusion of a male-type attachment object pushes the respective walls 39 of the central tube 21 to be inclined radially outwardly, and the respective walls 29 are moved back to their original positions immediately after the head having a wider width of the engagement protrusion passed there-through. Accordingly, a peripheral surface of a neck having a narrower width of the engagement protrusion will be surrounded by the round edges 22. For example, the neck of the engagement protrusion will be pushed radially inwardly by the round edges 22 of the respective walls 29. Accordingly, the male and female snaps, in particular the engagement protrusion of the male-type snap and the central tube 21 of the female-type snap will be snap-coupled.

The above-described central tube 21 may be configured by: forming the round edges 22 by folding top ends of the central tube 21 radially inwardly; and then forming the slits 23 at constant or different interval in the circumferential direction. It should be noted that the attachment object 20 can be produced by drawing a metal plate and the like. An embodiment is envisaged where the attachment object 20 is produced by an injection molding of resin. A structure of the central tube 21 should not be limited to an illustrated example, and could take any of various types of structures.

The flange 24 extends upward, radially outward from a first end 24*a* coupled to a bottom end 21*a* of the central tube 21, then is curved radially inwardly to be an arc-like shape, and ends at a second end 24*c*. The first end 24*a* of the flange 24 is positioned downward, radially inward of the second end 24*c*. An opening OP25 is arranged between the first end 24*a* and the second end 24*c* of the flange 24. Legs of the fastening member 10 described below can enter into an internal space 25 of the flange 24 through the opening OP25 of the flange 24. Note that, along the axial line AX, the upper-most portion of the flange 24 is positioned upward relative to the upper-most portion of the central tube 21. The upper-most portions of the flange 24 and the central tube 21 indicate portions that is farthest from the fabric 30 along the axial line AX. The round edges 22 of the central tube 21 are suitably arranged closer to the fabric 30 than the upper-most portion of the flange 24. The internal space 25 in the flange 24 is continuous in the circumferential direction around the axial line AX and the central tube 21.

The fastening member 10 has an annular base 11, and a plurality of legs 12 each stands up toward the fabric 30 from a radially inner end of the annular base 11. Any number of legs 12 can be used and, in some cases, five legs 12 are provided. Each leg 12 has a sufficient sharpness for penetrating through the fabric 30. In the illustrated example, each leg 12 is narrowed in its width as being away from the annular base 11, and has a keen tip 12*p*. Preferably, the fastening member 10 is made of metal, but not necessarily limited thereto.

As shown in FIG. 2, the attachment object 20 is attached to the fabric 30 by the fastening member 10. The legs 12 of the fastening member 10 penetrate through the fabric 30, and then enter into the internal space 25 via the opening OP25 of the flange 24 of the attachment object 20. The legs 12 are guided along the upwardly, radially outwardly extending wall of the flange 24 and then are deformed by being guided by the arc-like curved wall. Accordingly, attachment of the attachment object 20 to the fabric 30 by the fastening member 10 is achieved. Regarding the attachment to the fabric 30, it is not a substantial issue whether the attachment object 20 is a male-type or a female-type. Likewise, specific structures of the male-type and female-type are not substantial.

A non-limiting exemplary configuration and operation of the attaching apparatus 100 will be described particularly with reference to FIGS. 3 to 10. Again, the attaching apparatus 100 attached the attachment object 20 to the fabric 30 using the fastening member 10. At a time shown in FIG. 3, the attachment object 20 is placed onto the top surface 31 of the fabric 30. The attachment object 20 is supplied onto the fabric 30 through processes described with reference to FIGS. 4 to 7 so that the attachment object 20 is placed onto the fabric 30. Following to FIG. 3, the second die operates as shown in FIGS. 8 to 10 so that the attachment object 20 is attached to the fabric 30 by the fastening member 10.

As an overview, the attaching apparatus 100 has at least one pair of first holding members 40 configured to hold an attachment object 20, and a first die 110 configured to hold the attachment object 20 at a terminal 111 of a die main body 110*k*. The first die 110 moves such that the attachment object 20 held by the at least one pair of first holding members 40 is held at the terminal 111 of the die main body 110*k* and then the attachment object 20 is placed onto the fabric 30. The attachment object 20 is transferred from the at least one pair of first holding members 40 to the first die 110 at a position distanced away from the fabric 30 in an axial direction. Accordingly, it would be possible to avoid that the attachment object 20 held by the first holding member 40 takes an incorrect posture influenced by the step (level/height difference) of the fabric 30 or the fabric product. In some embodiments, the first die 110 is moved by any type of driving device 90, not necessarily limited to this through. The driving device 90 includes a driving source 91 and a linkage 92, for example. Types of the driving source and specific configuration of the linkage could be various. It should be noted that the die main body of the first die can be referred alternatively as a punch.

In some cases including the illustrated example, the attachment object 20 is released from the at least one pair of first holding members 40 synchronously with the transfer of the attachment object 20 from the at least one pair of first holding members 40 to the first die 110. In some cases including the illustrated example, the first die 110 moves toward the fabric 30 such that the respective first holding members 40 are moved. In other words, when moving toward the fabric 30, the first die 110 touches the first holding members 40 and causes the respective first holding members 40 to be moved away from one another. As a result of this, the attachment object 20 is released from the at least one pair of first holding members 40. Accordingly, the configuration of the attaching apparatus 100 would be simplified, and a timing when the attachment object 20 is held at the terminal 111 of the first die 110 and a timing when the attachment object 20 is released from the at least one pair of first holding members 40 can be determined based on mechanical setting.

Referring to the illustrated example for this point, as shown in FIG. 3, the die main body 110*k* of the first die 110 includes an increased-diameter portion 115 having a diameter that gradually increases as being away from the terminal 111 of the die main body 110*k*. As would be understood from FIGS. 6 and 7, the increased-diameter portion 115 of the die main body 110*k* moves the respective first holding members 40 radially outwardly. Accordingly, the attachment object 20 is released from the at least one pair of first holding members 40. Relative position between the terminal 111 and the increased-diameter portion 115 determines the time window between a timing when the attachment object 20 is held at the terminal 111 of the die main body 110*k* and a timing when the attachment object 20 is released from the at least one pair of first holding members 40. Note that the first holding member 40 is provided with a bearing structure 54 that bears a force directed radially outward from the increased-diameter portion 115 of the die main body 110*k*.

In more detail with no intension of narrowing, the die main body 110*k* of the first die 110 of an illustrated example includes an axial member which includes, in the order of being away from the fabric 30, a terminal 111, an increased-diameter portion 114, an axial portion 112, an increased-diameter portion 115, and an axial portion 113. Hereinafter, the increased-diameter portion 114 may possibly be referred to a first increased-diameter portion, and the increased-diameter portion 115 may possibly be referred to a second increased-diameter portion. The first increased-diameter portion 114 is positioned radially inwardly of the second increased-diameter portion. The axial portion 112 may possibly be referred to a first axial portion, and the axial portion 113 may possibly be referred to a second axial portion. The first axial portion 112 has a smaller diameter than that of the second axial portion 113.

The terminal 111 may be an axial portion. In a case shown in FIG. 3 and so on, the bottom portion and/or the bottom surface of the terminal 111 facing the fabric 30 is configured to hold the attachment object 20 detachably, not necessarily limited to this through. That is, the bottom portion and/or the bottom surface of the terminal 111 may be configured to snap-coupled with the attachment object 20. As would be understood from the following descriptions, the manner of the attachment object 20 being held by the first die 110 at the terminal 111 of the die main body 110*k* would be various, and should not be limited to the disclosed examples.

The first increased-diameter portion 114 is positioned between the terminal 111 and the first axial portion 112, and has a diameter that gradually increases as being away from the terminal 111. The peripheral surface of the first increased-diameter portion 114 is a sloped surface that is sloped radially outwardly as being away from the terminal 111 and the fabric 30. The second increased-diameter portion 115 is positioned between the first axial portion 112 and the second axial portion 113, and has a diameter that gradually increases as being away from the first axial portion 112. The peripheral surface of the second increased-diameter portion 115 is a sloped surface that is sloped radially outwardly as being away from the terminal 111 and the fabric 30.

Each first holding member 40 is configured to hold the attachment object 20 in corporation with one or more other first holding members 40. Each holding member 40 is displaceable between a first posture/position where the attachment object 20 is held as shown in FIGS. 4 to 6 and a second posture or position where the attachment object 20 released as shown in FIG. 7. For example, the first holding member 40 may be urged to the first posture or position by a non-illustrated elastic member such as a spring.

Each first holding member 40 is provided with a recess 45 that receives the flange 24 of the attachment object 20. When the first holding member 40 takes the first posture or position, each recess of the first holding member 40 faces in a direction perpendicular to the axial line AX i.e. radially inward and in the illustrated example, it faces the recess 45 of another first holding member 40. The recess 45 is recessed in an arc along the peripheral surface of the flange 24.

In some cases including the illustrated example, the first holding member 40 includes a pivotable arm member 50. The arm member 50 includes a pivotal axis 51 and a supporting end 52 for holding the attachment object 20. The pivotal axis 51 is arranged at an upper side of the arm member 50. The supporting end 52 is arranged at a lower side of the arm member 50 and includes a portion that extends radially inwardly. The supporting end 52 is provided with the above-described recess 45. In a case where the arm member 50 is employed as the first holding member 40, the attachment object 20 can be suitably transferred to the terminal 111 of the die main body 110*k* while avoiding an interference with the die main body 110*k* of the first die 110 descending from the upper side.

Optionally, the arm member 50 has a pushed surface 53 between the pivotal axis 51 and the supporting end 52. The pushed surface 53 is pushed radially outwardly by the increased-diameter portion 115 of the die main body 110*k*. In some cases, the pushed surface 53 includes a sloped surface or arc surface that is directed downward, i.e. toward the fabric 30, as extending radially inwardly. In this case, the linear motion of the die main body 110*k* along the axial line AX is more smoothly converted to the pivoting motion of the arm member 50. In the illustrated example, the bearing structure 54 positioned between the pivotal axis 51 and the supporting end 52 is shaped like a disk and provides an arc surface that corresponds to the pushed surface 53. The bearing structure 54 is arranged closer to the pivotal axis 51 than the supporting end 52 so that pivoting of the arm member 50 in a more appropriate, e.g. larger angle range can be achieved.

Pivoting angle of the arm member 50 is equal to an arc-like moving distance of the supporting end 52 about the pivotal axis 51. In a case where the pivoting angle of the arm member 50 is greater, the supporting end 52 can move up to a position that is farther from the axial line AX. Pivoting speed of the arm member 50 is correlated with moving speed of the supporting end 52. Pivoting angle and speed of the arm member 50 are appropriately set, effectively avoiding an interference between the supporting end 52 of the arm member 50 and the terminal 111 of the die main body 110*k*.

Each arm member 50 is pivotable between a first posture where the attachment object 20 is held as shown in FIGS. 4 to 6 and a second posture where the attachment object 20 is released as shown in FIG. 7. For example, the arm member 50 is urged toward the first posture by a spring not-illustrated. Each arm member 50 takes the first posture while no force is applied from the die main body 110*k* of the first die 110 so that the attachment object 20 is held, i.e. sandwiched and grasped, by the at least one pair of arm member 50.

In some cases including the illustrated example, the attaching apparatus 100 further includes a base portion 60 to which the arm members 50 are axially coupled, and the base portion 60 is a stationary portion that is not displaced in the attaching apparatus, not necessarily limited to this through. The arm member 50 is axially coupled to the base portion 60, allowing more stable pivoting of the arm member 50 and in turn allowing more smooth transfer of the attachment object 20 from the arm members 50 to the first die 110.

The attaching apparatus 100 has a second die 120 additionally to the first die 110. Specific configuration of the second die 120 can be various. The second die 120 can be just a flat plate onto which the fastening member 10 is placed. In the illustrated case, the second die 120 has a pin 121 to be inserted into the annular base 11 of the fastening member 10, and a pusher 122 that is arranged around the pin 121 and that pushes the fastening member 10 toward the attachment object 20 held at the terminal 111 of the die main body 110*k* of the first die 110. However, as described above, differently structured second die 120 can be employed in another example.

As would be understood from FIG. 8, the pin 121 is a solid cylinder and the bottom surface 32 of the fabric 30 is arranged onto its top surface. The pusher 122 is a hollow cylinder that pushes the fastening member 10 toward the attachment object 20. In some cases, the pin 121 is arranged inside of the hollow cylinder of the pusher 122 with a slight clearance, and the pin 121 can slide within the hollow cylinder of the pusher 122. As the pin 121 is arranged radially inward of the legs 12 of the fastening member 10, the fastening member 10 can take more appropriate posture while the fastening member 10 is moved upward toward the fabric 30 by the pusher 122. In some cases, the leg 12 of the fastening member 10 slides on the peripheral surface of the pin 121, not necessarily limited to this through.

The second die 120 further has at least one pair of second holding members 123 that holds the fastening member 10. The respective second holding members 123 are urged radially inwardly by any urging means such as a spring so as to sandwich the fastening member 10. The fastening member 10 is held by the pair of second holding members 123, facilitating that the fastening member 10 maintains its appropriate posture. As would be understood from FIGS. 8 and 9, the movement of the pusher 122 toward the fabric 30 causes the movement of the respective second holding members 123 i.e. radially outwardly, allowing the fastening member 10 to be released from the pair of second holding members 123. Each second holding member 123 has a sloped surface that matches a sloped surface at the top end of the pusher 122 so that an upward displacement of the pusher 122 is appropriately converted into a radially outward displacement of the second holding member 123.

The second die 120 has a tube 124 on which the second holding members 123 are placed, and a seat 125 placed on the second holding members 123. The fabric 30 is arranged on the seat 125.

Hereinafter, with reference to FIGS. 6 to 10, operation of the fastening member 10 will be described. As an overview, described are a method of attaching an attachment object 20 to a fabric 30 using a fastening member 10 and a method of producing a fabric product 30 to which an attachment object 20 is attached using a fastening member 10. The respective methods include:

- supplying an attachment object 20 to at least one pair of first holding members 40;
- moving a first die 110 toward the attachment object 20 being held by the at least one pair of first holding members 40 such that the attachment object 20 is held at a terminal 111 of a die main body 110*k* of the first die 110;
- releasing the attachment object 20 from the at least one pair of first holding members 40 synchronously with the attachment object 20 being held at the terminal 111; and
- moving the first die 110, in which the attachment object 20 is held at the terminal 111, to carry the attachment object 20 until the attachment object 20 is in contact with the fabric 30.

In an aspect of the present disclosure, the attachment object 20 is transferred from the at least one pair of first holding members 40 to the first die 110 at a position distanced away from the fabric 30 in the axial direction. Accordingly, it would be possible to avoid that the attachment object 20 held by the first holding member 40 takes an incorrect posture influenced by the step (level/height difference) of the fabric or the fabric product.

FIG. 4 illustrates a condition before the at least one pair of first holding members 40 holds the attachment object 20. FIG. 5 illustrates a condition in which the at least one pair of first holding members 40 holds the attachment object 20. The attachment objects 20 may be supplied to the first holding members 40 via a non-illustrated supply channel for the attachment objects 20 which may sometimes be referred to as a chute. In particular, the attachment object 20 would be supplied between the supporting ends 52 of the arm members 50, and would be sandwiched and held between the supporting ends 52 of the arm members 50. For example, an attachment object 20 is supplied to a space between the supporting ends 52 based on sliding along a direction parallel to the pivotal axis 51 of the arm member 50 of FIG. 4. When the attachment object 20 is inserted between the supporting ends 52 of the arm members 50, they pivot from the first posture toward the second posture, and then they are moved back to the first posture from the second posture side. As such, the attachment object 20 is supplied to the at least one pair of first holding members 40 and the attachment object 20 is held by the at least one pair of first holding members 40.

As would be understood from FIGS. 5 and 6, the die main body 110*k* of the first die 110 is moved downward by the driving device 90 toward the attachment object 20 being held by the at least one pair of first holding members 40 and toward the fabric 30. During this process, the attachment object 20 is held at the terminal 111 of the die main body 110*k* of the first die 110. That is, the attachment object 20 is transferred from the at least one pair of first holding members 40 to the first die 110. This transfer of the attachment object 20 from the at least one pair of first holding members 40 to the first die 110 is performed at a position and height distanced away from the fabric 30. Therefore, it would be possible to avoid an interference between the first holding member 40 and the fabric 30, particularly a step (level/height difference) of the fabric 30, facilitating proper attachment of the attachment object 20 to the fabric 30.

In the illustrated example, when the die main body 110*k* of the first die 110 touches the attachment object 20, the attachment object 20 is held by the at least one pair of first holding members 40, i.e. held by the pair of arm members 50. The arm members 50 take the first position. Also, when the attachment object 20 is held at the terminal 111 of the die main body 110*k* of the first die 110, the attachment object 20 is held by the pair of first holding members 40, i.e. the pair of arm members 50. Stable transfer would be facilitated for the attachment object 20 from the pair of first holding members 40 to the first die 110.

As would be understood from FIGS. 6 and 7, after the transfer of the attachment object 20 from the at least one pair of first holding members 40 to the first die 110 has been completed, in other words after the attachment object 20 is snap-coupled with the terminal 111 of the die main body 110*k*, the die main body 110*k* of the first die 110 further descends downward toward the fabric 30. Releasing of the attachment object 20 from the at least one pair of first holding members 40 initiates synchronously with that the attachment object 20 is held by and snap-coupled with the terminal 111 of the die main body 110*k* of the first die 110. The second increased-diameter portion 115 of the die main body 110*k* of the first die 110 pushes the pushed surface 53 of each arm member 50, allowing the respective arm members 50 to pivot so that the attachment object 20 is released from the pair of arm members 50. In some cases, the release of the attachment object 20 from the at least one pair of first holding members 40 initiates directly before or at the same time as or directly after the attachment object 20 is held at the terminal 111 the die main body 110*k* of the first die 110. Language of "synchronously" would involve all of these three instances.

As the die main body 110*k* of the first die 110 moves downward toward the fabric 30, the second increased-diameter portion 115 of the die main body 110*k* of the first die 110 touches the pushed surfaces 53 of the respective arm members 50 to force the respective arm members 50 to pivot radially outwardly. As the pivoting of each arm member 50 progresses, the attachment object 20 will be not sandwiched and held between the supporting ends 52 of the respective arm members 50, i.e. the attachment object 20 would be released. Before this release of the attachment object 20, the attachment object 20 is held at the terminal 111 of the die main body 110*k* of the first die 110. Therefore, the attachment object 20 is effectively avoided to be dropped off.

The die main body 110*k* of the first die 110 moves to an attachment position where the attachment object 20 is placed onto the fabric 30 as shown in FIG. 8. The die main body 110*k* of the first die 110 serves to push the flange 24 of the attachment object 20 from the upper side. The second die 120 handles the fastening member 10 such that the legs 12 of the fastening member 10 penetrate through the fabric 30 and then are inserted into the internal space 25 of the flange 24 of the attachment object 20 on the fabric 30. Accordingly, the attachment object 20 is attached to the fabric 30 by the fastening member 10. Configuration and operation of the second die 120 could be various in respective embodiments, but a non-limiting example will be described with reference to FIGS. 8 to 10 by way of precaution.

At a time shown in FIG. 8, the pin 121 has been inserted in to the annular base 11 of the fastening member 10. In a case the posture of the leg 12 of the fastening member 10 is slant radially inwardly compared to a normal posture, the posture of the leg 12 of the fastening member 10 can be corrected by inserting the pin 121 into the annular base 11 of the fastening member 10, ensuring more secure penetration through the fabric and more secure insertion into the flange 24. For the sake of convenience, drawing illustrating a condition before the pin 121 is moved toward the fabric 30 and is inserted into the annular base 11 of the fastening member 10 is omitted.

At a time shown in FIG. 8, the fastening member 10 is placed on the top end of the pusher 122, and is sandwiched between the pair of second holding members 123. While the pusher 122 is moved upward from a position shown in FIG. 8 to a position shown in FIG. 9, the pair of second holding members 123 is pushed radially outwardly by the pusher 122, releasing the restrained fastening member 10 from the pair of second holding members 123. At a time shown in FIG. 9, the legs 12 of the fastening member 10 being pushed by the pusher 122 pierce the fabric 30. While the pusher 122 is moved upward from a position shown in FIG. 8 to a position shown in FIG. 9, the legs 12 of the fastening member 10 penetrate through the fabric 30. Then, the legs 12 are inserted into the internal space 25 of the flange 24 of the attachment object 20 placed on the top surface 31 of the fabric 30, and they are bent along the wall portion of the flange 24. An embodiment is envisaged where the die main body 110*k* of the first die 110 is slightly moved downward in synchronization with a timing when the legs 12 of the fastening member 10 penetrate through the fabric 30 or are inserted into the internal space 25 of the flange 24.

As shown in FIG. 11, the terminal 111 of the die main body 110*k* at which the attachment object 20 is held may have an engagement protrusion 111*a* extending along the axial line AX, a groove 111*b* provided around the engagement protrusion 111*a*, and a pushing portion 111*c* provided around the groove 111*b*.

The engagement protrusion 111*a* has a constricted shape so as to be engaged with the central tube 21 of the attachment object 20, i.e. has a narrow-width neck and a wide-width head. The groove 111*b* is provided to avoid an interference with the central tube 21 of the attachment object 20, and partially receives the top portion of the central tube 21. The pushing portion 111*c* is a portion capable of pushing the attachment object 20, e.g. its flange 24 from the upper side. The attachment object 20 is pushed by the pushing portion 111*c*, ensuring that the legs 12 of the fastening member 10, having entered into the internal space 25 of the flange 24 of the attachment object 20, are curved along the wall surface of the flange 24. The pushing portion 111*c* includes a slant portion having an arc-shaped sloped surface extending upward, radially outward. As such the terminal 111 of the die main body 110*k* is configured to be elastically engaged with the central tube 21.

FIG. 12 shows a non-limiting example where the attachment object 20 is a male-type snap and the first die 110 is configured to be adapted for the snap. In a case shown in FIG. 12, likewise the case of FIG. 11, the first die 110 is configured to hold the attachment object 20 at the terminal 111 of the die main body 110*k*. As shown in FIG. 12, the first die 110 has a die main body 110*k* and a pressing member 116 to hold the attachment object 20 at the terminal 111 of the die main body 110*k*. The pressing member 116 can be elastically displaceable. In such a case either, similar technical effect as those described above would be obtained.

In FIG. 12, the pressing member 116 is a leaf-spring. However, in another example, members other than the leaf-spring could be employed. In FIG. 12, one leaf-spring can be employed as a pressing member 116. A case is envisaged where a plurality of pressing members 116 is employed. Note that the elastic displacement of the pressing member indicates that at least a part of or the entirety of the pressing member is displaced from a first position to a second position, and then it is capable of moving back automatically to the first position from the second position.

Specific structure and configuration of the first die 110 would be properly determined in accordance with a type or size or shape of the attachment object 20. The terminal 111 of the illustrated exemplary die main body 110*k* includes a central hole 111*f* that receives the central protrusion 27 of the male-type attachment object 20, and a wall 111*g* that is arranged around the central hole 111*f* or that defines the central hole 111*f*. The wall 111*g* is provided with a cutout for avoiding an interference with the pressing member 116. A shape of the terminal 111 of the die main body 110*k* would be properly determined in accordance with a type of or the number of the pressing member 116. As shown in FIG. 12, the attachment object 20, particularly its central protrusion 27 is sandwiched and held between the wall surface of the wall 111*g* of the die main body 110*k* and the pressing member 116.

FIGS. 13 to 17 illustrate that the attachment object 20 is held at the terminal 111 of the die main body 110*k* differently to the above manners. Even in the exemplary embodiment of FIGS. 13 to 17, likewise the above exemplary embodiments, the first die 110 is configured to hold the attachment object 20 at the terminal 111. In the present exemplary embodiment, the first die 110 has a die main body 110*k*, and a plurality of pressing members 116 to hold the attachment object 20 at the terminal 111 of the die main body 110*k*. Each pressing member 116 can be elastically displaceable. Even in such a case, similar technical effect would be achieved as the exemplary embodiments described above.

In the illustrated example, a plurality of pressing members 116 are arranged to sandwiches the die main body 110*k*. In the illustrated example, the plural pressing members 116 are coupled via an elastic member. In more detail, paired pressing members 116 are coupled via one elastic member 117. In more detail, a spring can be used as the elastic member 117. The spring may be provided in a hole that penetrates through the die main body 110*k*. A first end of the spring is coupled to one pressing member 116 such that a spring force can be applicable thereto, and a second end of the spring is coupled to the other pressing member 116 such that a spring force can be applicable thereto. In the illustrated example, an end of the spring is coupled to a plate member 116*n* housed in a recess 116*m* of the pressing member 116 via a hole of the pressing member 116. Each pressing member 116 receives a spring force from the spring via the plate member 116*n*, and is urged radially inward of the die main body 110*k*. When the attachment object 20 is not sandwiched between the pair of pressing members 116, each pressing member 116 touches the peripheral surface of the die main body 110*k*. Other manners would be envisioned where the spring is arranged to surround the die main body 110*k*.

As shown in FIG. 13, before the attachment object 20 is held at the terminal 111 of the die main body 110*k*, an interval W116 of the pair of the pressing members 116 is at the minimum value. As shown in FIG. 14, after the attachment object 20 is held at the terminal 111 of the die main body 110*k*, the terminal 116*j* of each pressing member 116 is protruded to the attachment object 20 side and the fabric 30 side than the terminal 111 of the die main body 110*k*. This protrusion amount would be properly determined in accordance with the size and shape of the attachment object 20. The terminal 116*j* of the pressing member 116 may be referred to as a bottom end portion of the pressing member 116, provided that the die main body 110*k* moves toward the fabric 30 arranged at the downside. This holds true for the terminal 111 of the die main body 110*k*, i.e. this may be referred to as a bottom end portion 111. If necessary, the bottom end portion of the die main body 110*k* may be referred to as a die bottom end portion, and the bottom end portion of the pressing member 116 may be referred to as a pressing member bottom end portion.

At a time shown in FIG. 15, the attachment object 20 is held at the terminal 111 of the die main body 110*k*, and the interval W116 of the pair of pressing members 116 becomes slightly greater from the minimum value. At a time shown in FIG. 15, the terminal 116*j* of each pressing member 116 is slightly displaced radially outward of the die main body 110*k*. The attachment object 20 is held between the pair of pressing members 116 so that the attachment object 20 is held at the terminal 111 of the die main body 110*k*. As shown in FIG. 15, the attachment object 20 touches the terminal 111 of the die main body 110*k*.

Through a process shown in FIG. 16, the attachment object 20, held at the terminal 111 of the die main body 110*k* by the pair of pressing members 116, will be released onto the fabric 30. In this exemplary embodiment either, as described with reference to FIGS. 8 to 10, the fastening member 10 is supplied to the fabric 30 and the attachment object 20 is attached to the fabric 30 by the fastening member 10.

When the first die 110 moves toward the fabric 30 while the attachment object 20 is held at the terminal 111 of the die main body 110*k* by the pair of pressing members 116, each pressing member 116 touches the top surface 31 of the fabric 30, and each pressing member 116 is displaced in a direction away from the fabric 30, as would be understood from FIG. 16. On the other hand, the die main body 110*k* is controlled to push the attachment object 20 on the fabric 30 further into the fabric 30. As a result, the attachment object 20 held at the terminal 111 of the die main body 110*k* by the pair of pressing members 116 would be released onto the fabric 30.

The attachment object 20 released from the pair of pressing members 116 would be placed onto the pin 121 of the second die 120 via the fabric 30. The attachment object 20 would be attached to the fabric 30 by the fastening member 10 via the above-described cooperative operation of the first die 110 and the second die 120 with reference to FIGS. 8 to 10. FIG. 17 shows the attachment object 20 being attached to the fabric 30 and the first die 110 that has moved away from the fabric 30.

Any mechanism may be embedded into the first die 110 for recovering (moving back) the pressing member 116, displaced to the second position, to the first position in the axial direction. For example, the pressing member 116 may be urged by an elastic member so as to be moved back to a first position from a second position where it has been moved away from the fabric 30. As described above, when the pressing member 116 touches the top surface 31 of the fabric 30, the pressing member 116 will be displaced away from the fabric 30. In some cases, the terminal 116*j* of the pressing member 116 would recede, i.e. be displaced upward in the axial direction, from the terminal point of the terminal 111 of the die main body 110*k*. Note that the first position may be referred to as an initial position and the second position may be referred to as a displaced position.

In another example, the terminal 116*j* of the pressing member 116 has a bulge being bulged toward the fabric 30. Accordingly, the pressing member 116 can touch the fabric 30 more surely.

In another example, only one pressing member 116 of the pair of the pressing members 116 is arranged to touch the fabric 30. That is, at least one pressing member 116 selected from the plural pressing members 116 is arranged to be protruded toward the fabric 30 than the other pressing member 116.

As would be understood from FIGS. 13 to 17, the bar 150 provided in the die main body 110*k* is inserted into the openings 116*k* of the respective pressing members 116 so that an amount of displacement of the pressing members 116 relative to the die main body 110*k* in the axial direction would be restricted.

As would be understood from FIGS. 13 to 17, the terminal 111 of the die main body 110*k* has a central hole 111*f*, a wall 111*g* around the central hole 111*f*, and a pushing portion 111*c* that is provided at the terminal of the wall 111*g*. The shape of the terminal 111 of the die main body 110*k* would be properly determined in accordance with the size and shape of the attachment object 20.

In a case of exemplary embodiment of FIGS. 1 to 12, there is a possibility that the fabric 30 can be slightly entrained by the first die 110 moving away from the fabric 30 after the attachment object 20 is attached to the fabric 30 by the fastening member 10. In contrast, according to the present exemplary embodiment of FIGS. 13 to 17, such a problem that the fabric 30 may be entrained would be avoided, and stable supply of the attachment object 20 to the fabric 30 would be achieved.

FIG. 18 illustrates another example where the pair of first holding members 40 receive a force directly or indirectly from the die main body 110*k* of the first die 110 and are moved in a direction perpendicular to the axial line AX. Elastic member such as a spring can be used for repositioning the first holding member 40 to the first position.

FIG. 19 illustrates an example of configuration of driving device usable for the above-described various embodiments. As shown in FIG. 19, the driving device 90 includes a driving source 91 and a linkage 92. The driving source 91 may be any device or mechanism that is capable of generating a rotational force and for example, may include an electric motor or engine or the like. The linkage 92 transmits a driving force generated by the driving source 91 to the first die 110, and causes the reciprocating motion of the first die 110 (in particular the die main body 110*k*) along the axial line AX.

Optionally, the linkage 92 transfers a driving force to the slider 49 that supplies the attachment object 20 to an interspace between the supporting ends 52 of the pair of arm members 50, causing a reciprocating motion of the slider 49 additionally. Based on the mechanical or structural configuration, a timing of supplying the attachment object 20 to the pair of arm members 50 would be properly determined in relation to a position of the first die 110 along the axial line AX. That is, in some cases, the slider 49, which supplies the attachment object 20 to the pair of first holding members 40, is coupled via the linkage 92 to the driving source 91 that is common with the first die 110.

The linkage 92 includes a turning wheel 92*a* that rotates in accordance with a rotational force supplied from the driving source 91, a pivoting link 92*c* that is axially supported by a stationary portion in the attaching apparatus 100 and that pivots clockwise and counterclockwise in a limited angular range around the rotational axis 92*c*1, and a first link 92*b* that couples the turning wheel 92*a* and one end of the pivoting link 92*c*. The other end of the pivoting link 92*c* is coupled to the first die 110. One end of the pivoting link 92*c* and the slider 49 are coupled via second and third links 92*d*, 92*e*.

When the turning wheel 92*a* starts to rotate clockwise in a state shown in FIG. 19, the first link 92*b* is pulled downward, and the pivoting link 92*c* pivots counterclockwise. Accordingly, the first die 110 is moved upward away from the fabrics 30, and the slider 49 moves frontward so as to approach the arm members 50. When a portion of the first link 92*b* coupled to the turning wheel 92*a* reaches the bottom dead center, the first die 110 is positioned at the uppermost position, and the slider 49 exists at a terminal position of the frontward movement direction. The attachment object 20 is supplied between the supporting ends 52 of the pair of arm members 50. When the portion of the first link 92*b* coupled to the turning wheel 92*a* passes through the bottom dead center, the first die 110 is moved downward toward the fabrics 30, and the slider 49 moves backward. If desired, it is envisioned that the driving force from the driving source 91 is transmitted to the pin 121 or the pusher 122 of the second die 120.

Given the above teachings, a skilled person in the art would be able to add various modifications to the respective embodiments. Reference numerals in Claims are just for reference and should not be referred for the purpose of narrowly construing the scope of claims.

REFERENCE SIGNS LIST

10 Fastening member
20 Attachment object
30 Texture
40 First holding member
110 First die
111 Terminal portion
120 Second die

The invention claimed is:

1. An attaching apparatus that attaches an attachment object to a fabric using a fastening member, the apparatus comprising:

at least one pair of first holding members configured to hold an attachment object, and a first die configured to hold the attachment object at a terminal of a die main body, wherein the first die moves such that the attachment object, held by the at least one pair of first holding members, is held at the terminal of the die main body and then the attachment object is placed onto the fabric, the attachment object is transferred from the at least one pair of first holding members to the first die at a position distanced away from the fabric, and an element selected from the group consisting of:

(i) the first die comprises a plurality of pressing members for holding the attachment object at the terminal of the die main body, the plurality of pressing members being coupled via an elastic member;

(ii) the die main body includes an increased-diameter portion having a diameter that gradually increases as being away from the terminal, and the increased-diameter portion of the die main body moves the respective first holding members radically outwardly;

(iii) the first holding member includes a pivotable arm member, the arm member includes a pivotal axis and a supporting end for holding the attachment object, and the arm member has a pushed surface between the pivotal axis and the supporting end, the pushed surface being pushed radially outwardly by an increased-diameter portion of the die main body;

(iv) the fastening member comprises an annular base and a plurality of legs arranged along the annular base, and the apparatus further comprises a second die, the second die comprising: a pin that is inserted into the annular base; and a pusher that is arranged around the pin and pushes the fastening member toward the attachment object held by the terminal; and (v) the apparatus further comprises a slider that transfers the attachment object to the pair of first holding members, and the slider is coupled via a linkage to a driving source that is common with the first die.

2. The attaching apparatus according to claim 1 in which element (i) is selected, wherein the plurality of pressing members are arranged around the die main body and are displaceable in an axial direction of the die main body.

3. The attaching apparatus according to claim 1, wherein movement of the first die toward the fabric causes movement of the respective first holding members, allowing the attachment object to be released from the at least one pair of first holding members.

4. The attaching apparatus according to claim 1, wherein release of the attachment object from the at least one pair of first holding members initiates synchronously with that the attachment object is held at the terminal of the die main body.

5. The attaching apparatus according to claim 1, wherein the first holding member includes a pivotable arm member, and the arm member includes a pivotal axis and a supporting end for holding the attachment object.

6. The attaching apparatus according to claim 5, further comprising a base portion to which the arm member is axially coupled, the base portion being a stationary portion that is not displaced in the attaching apparatus.

7. The attaching apparatus according to claim 1, wherein the second die further comprises at least one pair of second holding members that holds the fastening member, and movement of the pusher toward the fabric causes movement of the respective second holding members, allowing the fastening member to be released from the at least one pair of second holding members.

8. An attaching apparatus that attaches an attachment object to a fabric using a fastening member, the apparatus comprising:

at least one pair of first holding members configured to hold an attachment object; and a first die configured to hold the attachment object at a terminal of a die main body, wherein the first die moves such that the attachment object, held by the at least one pair of first holding members, is held at the terminal of the die main body and then the attachment object is placed onto the fabric, the attachment object is transferred from the at least one pair of first holding members to the first die at a position distanced away from the fabric, and a bottom surface of the terminal of the die main body includes a protrusion extending along a central axial line of the main body and a groove provided around the protrusion to hold the attachment object detachably.

9. The attaching apparatus according to claim 8, wherein the bottom surface of the terminal of the die main body is shaped such that the attachment object is snap-coupled with the bottom surface of the terminal of the die main body.

10. The attaching apparatus according to claim 8, wherein the attachment object includes a central tube and a flange provided around the central tube, and the protrusion is configured to be snap-coupled with the central tube and the groove is configured to partially receive the central tube, and a pushing portion provided around the groove is configured for pushing the flange.

11. A method of attaching an attachment object to a fabric using a fastening member, the method comprising:

supplying an attachment object to at least one pair of first holding members;

moving a first die toward the attachment object, held by the at least one pair of first holding members, so that the attachment object is held at a terminal of a die main body of the first die;

releasing the attachment object from the at least one pair of first holding members synchronously with the attachment object being held at the terminal; and moving the first die, in which the attachment object is held at the terminal, to carry the attachment object until the attachment object is in contact with the fabric wherein the die main body includes an increased-diameter portion having a diameter that gradually increases as being away from the terminal, and the increased-diameter portion of the die main body moves the respective first holding members radially outwardly.

12. A method of producing a fabric product to which an attachment object is attached using a fastening member, the fastening member including an annular base and a plurality of legs arranged along the annular base, the method comprising:

supplying an attachment object to at least one pair of first holding members;

moving a first die toward the attachment object, held by the at least one pair of first holding members, so that the attachment object is held at a terminal of a die main body of the first die;

releasing the attachment object from the at least one pair of first holding members synchronously with the attachment object being held at the terminal;

moving the first die, in which the attachment object is held at the terminal, to carry the attachment object until the attachment object is in contact with the fabric inserting a pin of a second die into the annular base; and pushing the fastening member by a pusher of the second die toward the attachment object held by the terminal, the pusher being arranged around the pin.

* * * * *